United States Patent [19]

McMickle

[11] 4,185,732

[45] Jan. 29, 1980

[54] ARRANGEMENTS FOR AND METHODS OF IMPROVING AMPUL HANDLING CAPACITY IN AMPUL PROCESSING MACHINES

[75] Inventor: John F. McMickle, Piscataway, N.J.

[73] Assignee: Cozzoli Machine Co., Plainfield, N.J.

[21] Appl. No.: 859,152

[22] Filed: Dec. 9, 1977

Related U.S. Application Data

[63] Continuation-in-part of Ser. No. 769,188, Feb. 16, 1977, Pat. No. 4,096,683.

[51] Int. Cl.[2] ..... B65G 47/14; B65G 47/34

[52] U.S. Cl. ..... 198/455; 198/482; 198/484; 198/487

[58] Field of Search ..... 198/339, 343, 425, 429, 198/434, 453, 454, 455, 471, 482, 484, 487, 575, 576, 631, 796, 837, 476; 53/249, 250, 266 R, 282, 266 B; 141/129, 168, 176, 250

[56] References Cited

U.S. PATENT DOCUMENTS

| | | | |
|---|---|---|---|
| 1,167,496 | 1/1916 | Harders | 198/484 X |
| 1,775,381 | 9/1930 | Angus | 198/482 X |
| 2,245,694 | 6/1941 | Lindholm | 198/429 X |
| 2,389,496 | 11/1945 | Gagnon et al. | 198/455 |
| 2,560,995 | 7/1951 | Stiles | 198/455 |
| 2,722,305 | 11/1955 | McCabe | 198/482 |
| 2,827,997 | 3/1958 | Cozzoli | 198/476 |
| 3,072,239 | 1/1963 | Jones et al. | 198/482 X |
| 3,527,017 | 9/1970 | Taylor et al. | 53/282 X |

*Primary Examiner*—James L. Rowland

*Attorney, Agent, or Firm*—Kirschstein, Kirschstein, Ottinger & Cobrin

[57] ABSTRACT

Ampuls are processed through a plurality of workstations successively arranged along a path in an ampul processing machine. At one station, an anti-jammer device is operative for preventing ampuls being guided through a continuously converging infeed chute from jamming and blocking the path. An intermittently-driven chain conveyor advances ampuls along the path during advancement time periods in which the ampuls are conveyed from one station to the next, and maintains the conveyed ampuls within their respective stations for processing, i.e., filling or sealing, the ampuls during dwell time periods which alternate with the advancement time periods. At another station, a movable infeed shuttle is operative for feeding ampuls to the chain conveyor during each dwell time period. At still another station, a movable outfeed shuttle is operative for discharging ampuls from the chain conveyor during each dwell time period. The anti-jammer device, the infeed shuttle and the outfeed shuttle all serve to improve the ampul handling capacity of the ampul processing machine.

32 Claims, 27 Drawing Figures

FIG.15
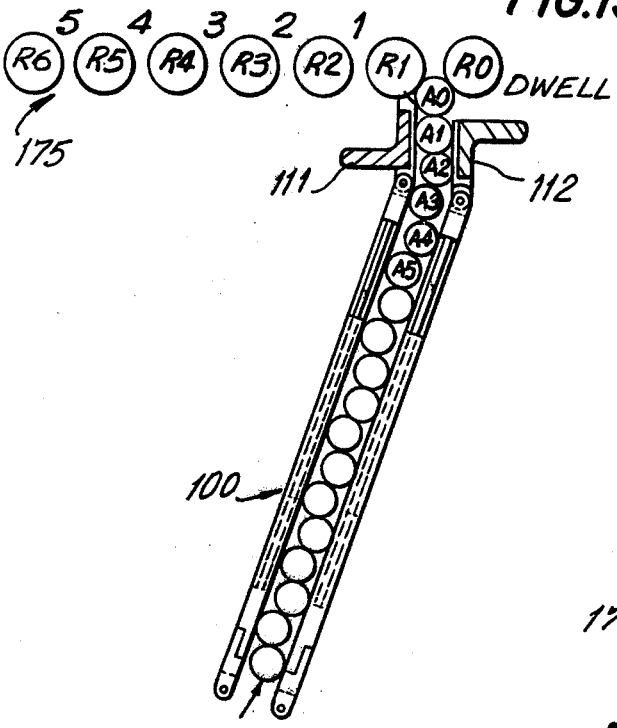
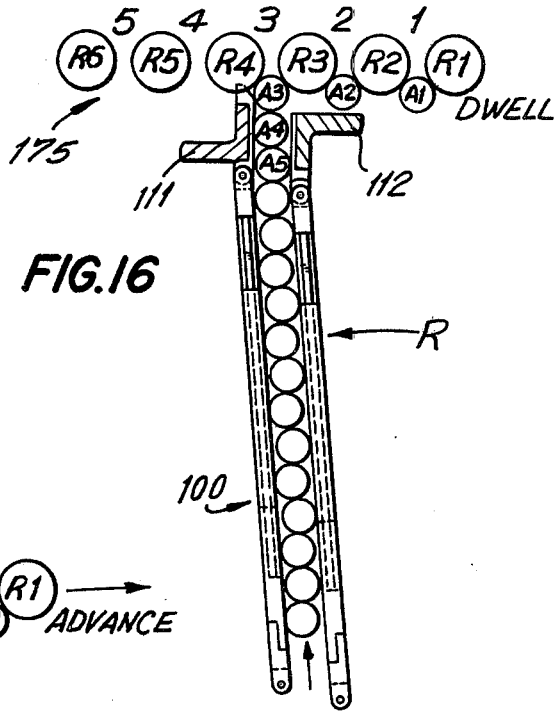
FIG.16
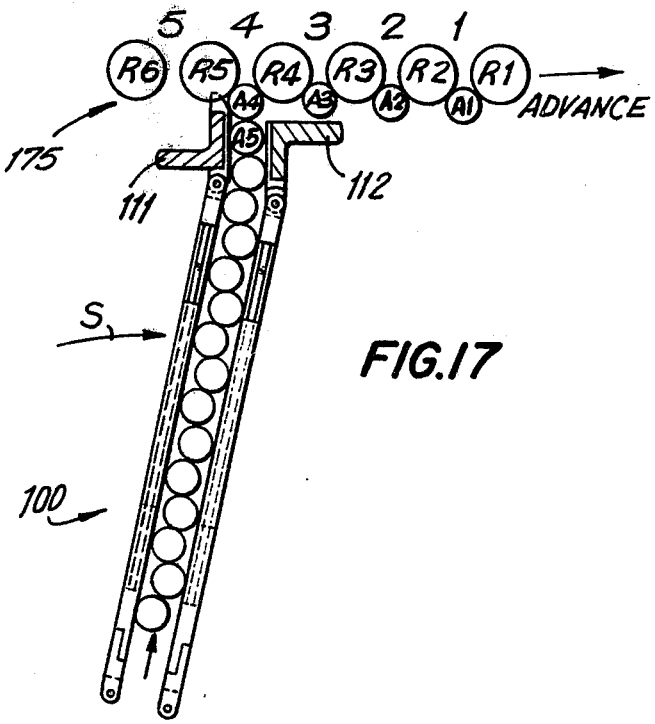
FIG.17

ARRANGEMENTS FOR AND METHODS OF IMPROVING AMPUL HANDLING CAPACITY IN AMPUL PROCESSING MACHINES

CROSS REFERENCE TO RELATED APPLICATIONS

This application is a continuation-in-part of my U.S. application Ser. No. 769,188, filed Feb. 16, 1977, for Ampoule Filling and Sealing Machine now issued as U.S. Pat. No. 4,096,683 dated June 27, 1978.

BACKGROUND OF THE INVENTION

1. Field of the Invention

The present invention generally relates to ampul processing machines and, more particularly, to arrangements for and methods of improving the ampul handling capacity of such machines.

2. Description of the Prior Art

It has been proposed in the art of ampul filling and sealing machines to fill glass ampuls with metered amounts of liquid medicament or the like, and to seal such filled ampuls by playing a flame around the middles of the necks of such ampuls, generally above a ceramic bead or ring disposed around the base of the neck of each ampul. In use, the ampul neck portion above the bead is snapped off at the ceramic bead, and a hypodermic needle is inserted into the ampul. The plunger of the syringe is operative to draw the medicament into the syringe and, after insertion of the needle into a patient's body, manual movement of the plunger towards the needle forces the medicament into the patient's body.

Known machines which process ampul sizes on the order of ½ cubic centimeter to 20 cubic centimeters have a handling capacity or throughput of approximately 120 ampuls per minute on a single line. In order to increase the throughput, it has also been proposed to increase the number of ampul lines. However, duplication of parts is an expensive expedient.

In order to keep the throughput high, it is desirable to quickly guide a relatively large number of ampuls through an infeed guide chute which converges downstream of ampul flow. However, ampuls often jam and bridge across the infeed guide chute, thereby blocking further ampul advancement.

In order to prevent such jamming, air-type or mechanical-type vibrators were used. However, air-type vibrators are objectionable because they are noisy and use non-sterile air. Mechanical-type vibrators are likewise noisy and have not proven altogether satisfactory in use.

It has further been proposed to intermittently advance a chain conveyor having ampul-receiving pockets past the filling and sealing stations of the machine. During a cycle of one second, for example, the chain conveyor takes ¼ second to advance and remains stationary for ¾ second. It is known to feed ampuls one at a time through a stationary infeed chute to the pockets of the chain conveyor.

In order to increase the throughput of the machine, it has also been proposed to feed two ampuls during the ¼ second advancement time period. The first ampul is shot into one pocket while the chain is advancing, and the second ampul is shot into another pocket just as the chain stops. This proposal has the drawbacks of limited speed and ampul breakage, particularly of the first ampul.

It has further been proposed to feed four ampuls during the ¼ second advancement time period. Now the first, second and third ampuls must be shot into three successive pockets while the chain is advancing, and the fourth ampul must be shot into the last pocket just as the chain stops. The drawbacks of limited speed and ampul breakage are magnified with this proposal. It will be noted that each ampul only has 1/16 of a second to be fed into a moving pocket. The last ampul frequently does not have sufficient time to be registered into its pocket.

It has still further been proposed to discharge ampuls one at a time from the chain conveyor during the ¼ second advancement time period. An inclined jog or tongued guide is interposed transversely of the path of ampul travel. The chain conveyor advances the ampuls and deposits them against the jog, whereupon the jog diverts the ampuls away from the path. However, this proposal has the drawback that each ampul slams into the jog, thereby causing ampul breakage.

Another prior art proposal discharges ampuls two at a time against the jog. It will be recognized that propelling two ampuls against the jog during a ¼ second advancement time period greatly magnifies the problem of ampul breakage. Furthermore, it is known to drive the chain conveyor by a Geneva drive mechanism whose movement characteristic starts from zero speed, accelerates rapidly to a maximum value midway during the advancement stroke, and then decelerates rapidly towards zero. Thus, the first ampul is thrown against the jog at approximately maximum acceleration, and the second ampul also slams against the first ampul at high speed. Of course, the problem of ampul breakage increases for the discharge of more than two ampuls because the conveyor chain has to work faster.

SUMMARY OF THE INVENTION

1. Objects of the Invention

Accordingly, it is the general object of the present invention to overcome the drawbacks of the prior art mentioned above.

Another object of the present invention is to increase the ampul handling capacity of such ampul processing machines.

Still another object of the present invention is to prevent ampul jamming in such machines.

An additional object of the present invention is to increase the number of ampuls being fed to the conveyor chain without increasing ampul breakage.

A further object of the present invention is to reliably register ampuls into pockets of the conveyor chain.

Yet another object of the present invention is to increase the number of ampuls being discharged from the conveyor without increasing ampul breakage.

2. Features of the Invention

In keeping with these objects and others which will become apparent hereinafter, one feature of the invention resides, briefly stated, in a combination in an ampul processing machine having successive workstations arranged along a path which comprises means for guiding ampuls along a path. The guiding means includes an upstream portion, a downstream portion, and a throat portion intermediate the upstream and downstream portions. The upstream, throat and downstream portions all converge in smooth continuous manner downstream of the path. The machine also comprises anti-jamming means for preventing ampuls being guided through the guiding means from jamming generally transversely across the path to thereby bridge and block the same. The anti-jamming means includes a movable agitator adjacent the guiding means, and means for moving the agitator between a retracted position away from the path towards an extended position in which the agitator projects partially transversely across the path to thereby engage ampuls being guided along the same, and for moving the agitator while the latter remains in its extended position from one end operating position adjacent the downstream portion towards another end operating position adjacent the upstream portion to thereby displace ampuls engaged by the agitator in countercurrent direction of the path.

The above-described anti-jamming feature counteracts ampul jamming and bridging across the path in a reliable manner. The anti-jamming feature thus overcomes the unsterile air-type and noisy mechanical-type vibrators of the prior art.

In accordance with yet another feature of the invention, intermittent conveying means are provided for advancing ampuls along the path during advancement time periods in which the ampuls are conveyed from one workstation towards the next, and for maintaining the conveyed ampuls within their respective workstations for processing the ampuls during dwell time periods which alternate with the advancement time periods. A movable infeed shuttle is operative for feeding ampuls to the intermittent conveying means during each dwell time period.

The above-described feeding feature increases the ampul handling capacity of the machine without increasing the problem of ampul breakage. By moving the infeed shuttle during the heretofore unused dwell time period of the stationary intermittent conveying means, ampuls can be reliably loaded into the ampul-receiving pockets of the conveying means.

In accordance with still another feature of the invention, the movable infeed shuttle is movabale from one end limiting position towards another end limiting position in countercurrent direction of the path during each dwell time period, and is further movable between the other end limiting position towards the first-mentioned one end limiting position downstream of the path during each advancement time period. If it is desired to load n ampuls, then $n-1$ ampuls will be loaded during the movement in countercurrent direction of the path, and the last ampul will be loaded during the downstream movement.

Assuming a $\frac{1}{4}$ second advancement time period and a $\frac{3}{4}$ second dwell time period in a one second cycle for the intermittent conveying means and further assuming a requirement to load four ampuls, it will be noted that the present invention uses the heretofore unused $\frac{3}{4}$ second to load three ampuls, and the $\frac{1}{4}$ second time interval to load the fourth ampul.

Put another way, the prior art never proposed using the $\frac{3}{4}$ second stationary part of the cycle, whereas the present invention proposes using this $\frac{3}{4}$ dwell time period to load three ampuls. Furthermore, the prior art proposed loading the last ampul in 1/16 second while the drive was moving. The present invention proposes loading the last ampul during the entire $\frac{1}{4}$ advancement time period. Still furthermore, the prior art proposed advancing the last ampul into its respective pocket at a fast relative speed. On the other hand, the present invention proposes feeding the last ampul at a relatively slower speed because the infeed shuttle and the conveying means are both moving in the same direction downstream of the path during the loading of the last ampul.

In accordance with yet another feature of the present invention, a movable outfeed shuttle is operative for discharging ampuls from the intermittent conveying means during each dwell time period. The outfeed shuttle is moved transversely of the path between an aligned and an offset position in which an outfeed passage of the shuttle is respectively in alignment with and remote from the path.

The above-described discharging feature also increases the ampul handling capacity of the machine without increasing the problem of ampul breakage. By moving the outfeed shuttle during the heretofore unused dwell time period of the intermittent conveying means, ampuls can be reliably discharged. Furthermore, by moving the outfeed passage between an aligned and an offset position, the problems associated with throwing the ampuls against an inclined jog are avoided.

The methods of preventing jamming, of feeding ampuls and of discharging ampuls are likewise essential features of the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 15 is a top plan view of the infeed shuttle arrangement of FIG. 7 and shows the infeed shuttle in one end limiting operating position relative to the conveyor chain;

FIG. 16 is a view analagous to FIG. 15 and shows the infeed shuttle in another end limiting operating position;

FIG. 17 is a view analagous to FIG. 15 and shows the infeed shuttle in an operating position intermediate the end limiting positions of FIGS. 15 and 16;

DESCRIPTION OF THE PREFERRED EMBODIMENTS

GENERAL SYSTEM DESCRIPTION (FIG. 24)

Figure 24:
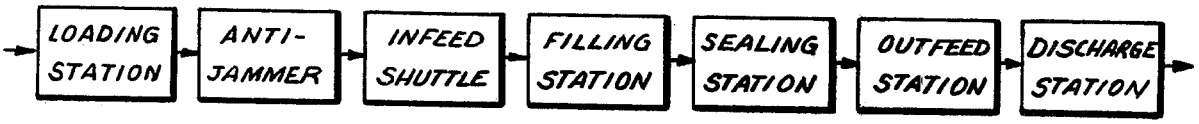
FIG. 24 is a block diagram representation showing the various parts of the ampul processing machine according to the present invention as arranged in direction of ampul flow.

The ampul processing machine according to the present invention is generally operative for automatically filling empty glass ampuls with liquid medicament or like filler substances, and for thereupon sealing the filled ampuls against contamination, evaporation and spillage. As considered in the direction of ampul flow with respect to FIG. 24, the ampuls are initially loaded, singly or preferably in batches, at a loading station at the infeed end of the machine. The ampuls are thereupon channeled through an inclined infeed chute which converges in downstream direction. The convergence of the infeed chute tends to result in jamming between adjacent ampuls, particularly in the narrow throat region of the chute. Hence, an anti-jammer device (see FIGS. 1-6) is provided at this throat region to counteract the tendency of the ampuls to bank-up or bridge in the throat region.

An infeed shuttle arrangement (see FIGS. 7-17) is provided at the downstream end of the infeed chute, and is operative for feeding ampuls in single file procession to an intermittently-driven conveyor chain. The conveyor chain has pockets for receiving the ampuls and for advancing them along the path towards a plurality of work stations which are successively arranged along the path. As described above, at least one of these work stations is operative for filling empty ampuls with liquid medicament, and at least another of these work stations is operative for sealing the filled ampuls. The filling and/or sealing operations of the ampuls at the filling and sealing work stations do not specifically form part of the present invention; hence, it is not believed to be necessary to specifically describe these aspects of the ampul processing machine in any great detail. Specific details of work stations in which filling and/or sealing operations occur are already known to those skilled in this art and are described, for example, in U.S. Pat. Nos. 2,749,688 and 2,827,997, the entire contents of both of said patents being hereby incorporated by reference. Of course, other non-illustrated work stations may likewise be provided along the path; for example, one such work station may sterilize the ampuls before or after filling of the latter, or center the ampuls, or remove the undesired upper neck portions of the ampuls after the latter have been sealed, etc.

The ampuls are eventually delivered to an outfeed shuttle arrangement (see FIGS. 18-23) which is operative for discharging ampuls in single file procession to a discharge station. The ampuls are unloaded from this discharge station.

The present invention specifically relates to the features of the anti-jammer device, the infeed shuttle arrangement and the outfeed shuttle arrangement. A detailed description of the structure and the method of operation of these various features is set forth hereinbelow.

ANTI-JAMMER DEVICE (FIGS. 1-6)

Figure 1:
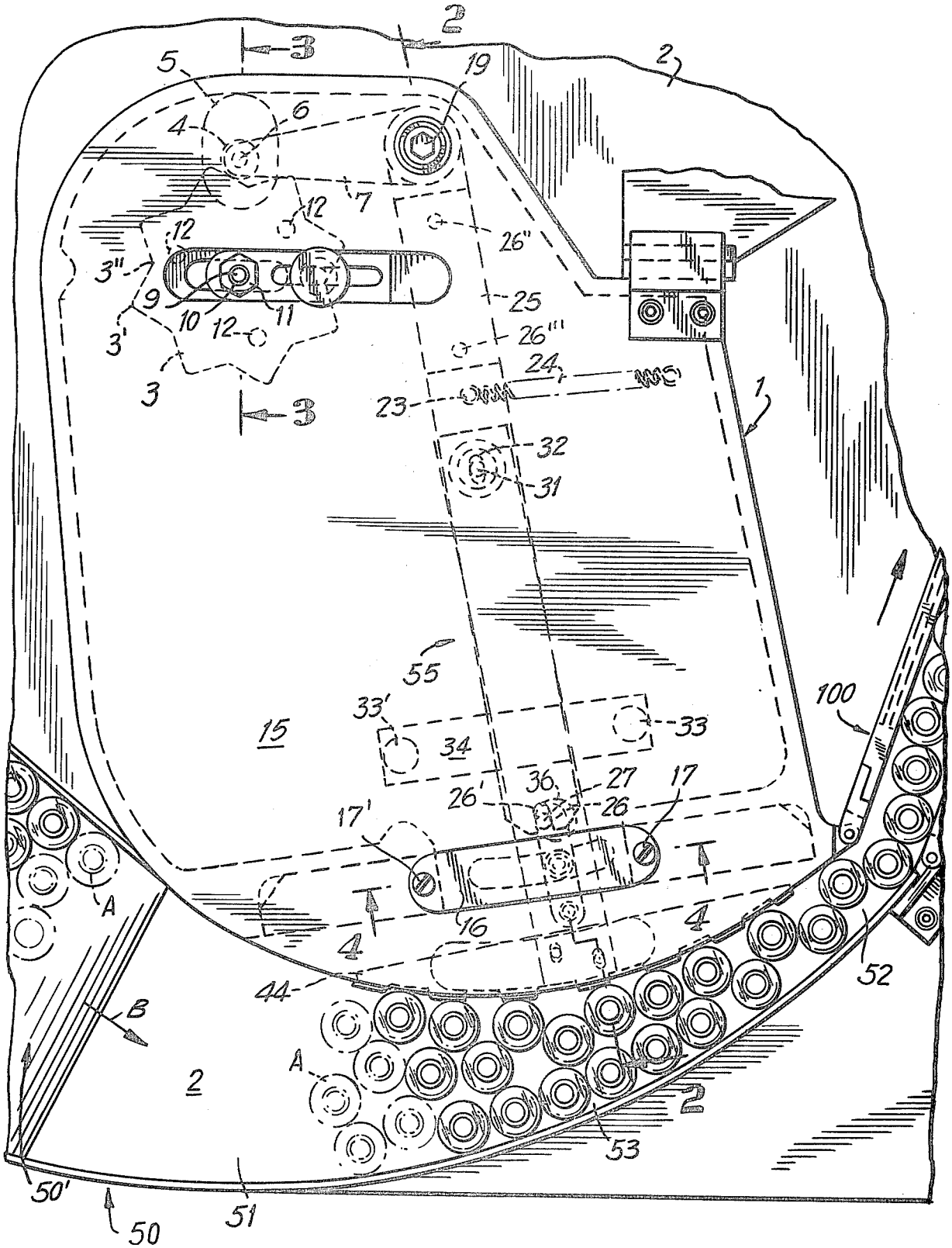
FIG. 1 is a fragmentary top plan view of an anti-jammer device of an ampul processing machine according to the present invention.
Figure 7:
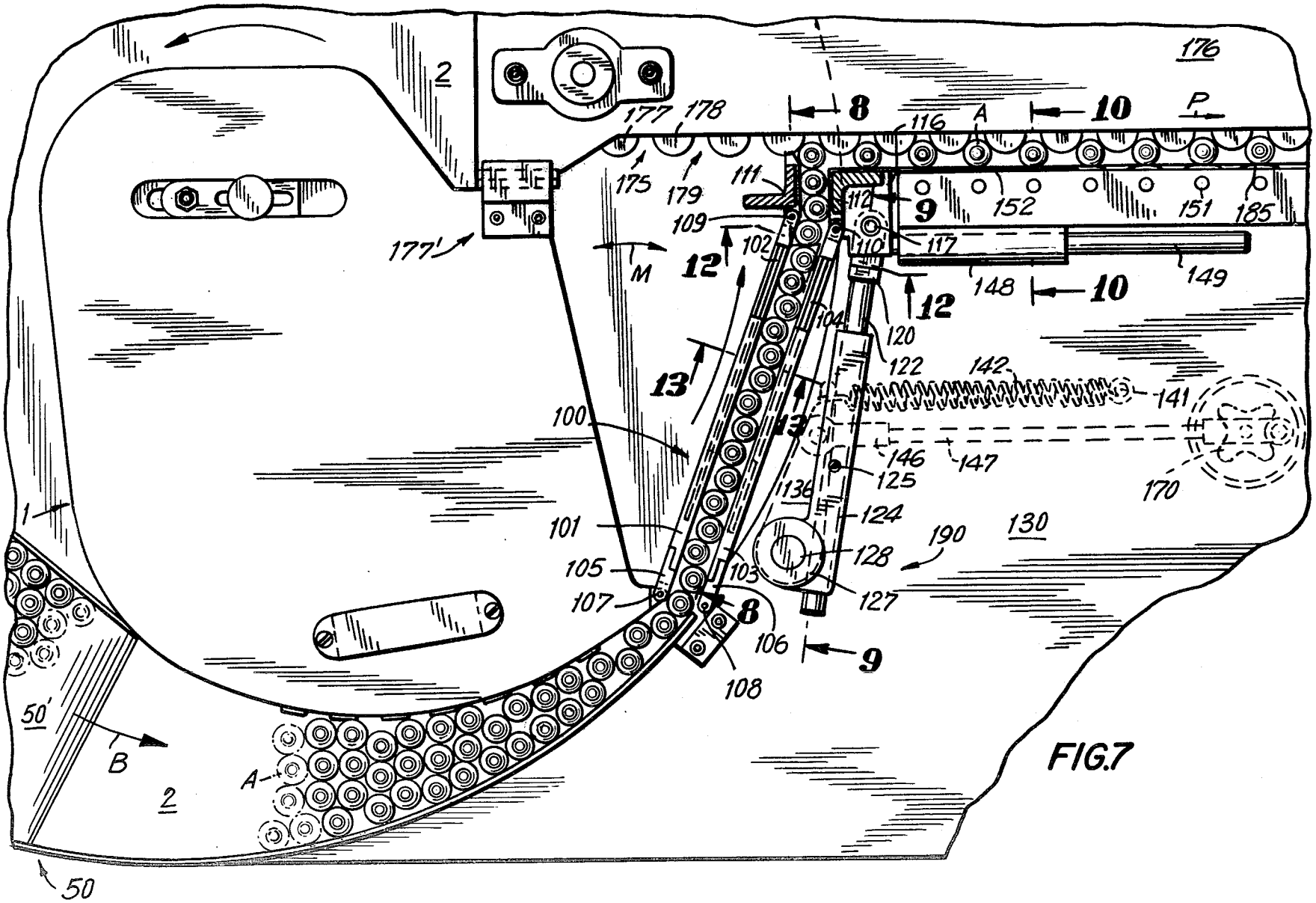
FIG. 7 is a fragmentary top plan view of the infeed end of the ampul processing machine and shows the anti-jammer device of FIG. 1 in top plan view, an intermittent conveyor chain in top plan view, and an infeed shuttle arrangement in top plan view and in partial section.

Reference numeral 1 in FIG. 1 generally identifies an anti-jammer device according to the present invention. Device 1 is mounted at the infeed end of the ampul processing machine intermediate inclined infeed chute 50 and infeed shuttle arrangement 100. FIG. 7 shows the positioning of the anti-jammer device 1 relative to the chute 50 and infeed shuttle 100 on a somewhat smaller scale.

The individual ampuls, identified throughout the drawings by the reference character A, are loaded on a loading station, either singly or preferably in batches, and from there are advanced along a path through guide chute 50 which converges downstream in direction of arrow B. The chute 50 includes an upstream portion 51 having a predetermined width transversely of the path and dimensioned to accommodate many ampuls, a downstream portion 52 having a transverse width less than the predetermined width and capable of accommodating a single ampul, and a throat portion 53 intermediate the upstream and downstream portions and having a transverse width which can accommodate more than one ampul and which is dimensioned less than said predetermined width but greater than the transverse width of the downstream portion 52. The guide chute 50 further includes an inclined ramp portion 50′ which advances the ampuls to the upper surface of rotary turntable 2.

During continuous operation of the machine, the ampuls advancing through the guide chute 50 tend to bridge or bank-up, particularly in throat region 53, thereby causing a jam past which ampuls from the upstream portion 51 cannot cross over towards the downstream portion 52. In order to counteract this tendency of the ampuls to jam and block the path of ampul flow, the anti-jammer device 1 is situated adjacent the guide chute 50 and is operative for engaging the ampuls particularly in the throat portion 53 and for moving the engaged ampuls from the throat portion 53 in countercurrent direction towards the upstream portion 51 to thereby prevent any jam from forming.

Figure 3:
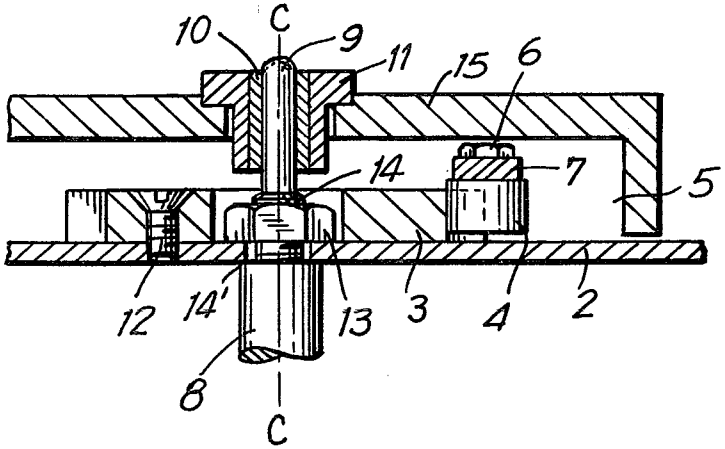
FIG. 3 is a vertical sectional view taken on line 3—3 of FIG. 1.

The device 1 is mounted above the rotary turntable 2 which is mounted on shaft 8 for rotation therewith (see FIG. 3). Cylindrical shaft 8 is driven by a non-illustrated drive, preferably a motor drive, about axis C—C and includes an end extension rod 9 and a threaded cylindrical portion 14 intermediate rod 9 and shaft 8. Cylindrical portion 14 has a smaller diameter than cylindrical shaft 8 to thereby form shoulder 14'. Nut 13 threadedly engages cylindrical portion 14 and clamps turntable 2 intermediate shoulder 14' and nut 13 when the latter is fully tightened to thereby mount turntable 2 for rotation with shaft 8. Extension rod 9 is journalled for rotation within bearing sleeve 10. Sleeve 10 is mounted in bushing 11 which in turn is mounted in cover plate 15.

A star-shaped cam 3 is mounted by three equidistantly spaced screws 12 on turntable 2 for rotation therewith about axis C—C. The outer peripheral cam surface of cam 3 has equidistantly and alternately spaced peaks 3' and valleys 3''. Cam follower or roller 4 is mounted on carrier arm 7 by fastener pin 6, and rides along the outer peripheral cam surface from one peak to valley and thereupon to the next peak and valley, as shown for example, in the successive views of FIGS. 5 and 6. Recess 5 is formed in the underside of cover plate 15 and grants clearance to the moving cam follower 4.

The rotation of cam 3 and the concomitant movement of cam follower 4 is employed not only to move agitator bar 44 in direction transversely of the path of advancement of the ampuls and into engagement with the ampuls being guided through the guide chute 50, but also to thereupon move agitator bar 44 from downstream portion 52 past throat portion 53 towards upstream portion 51. The ampuls engaged by the bar 44 will be displaced in direction countercurrent to said path, thus preventing any ampuls particularly in the vicinity of the throat portion 53 from blocking the path.

Figure 2:
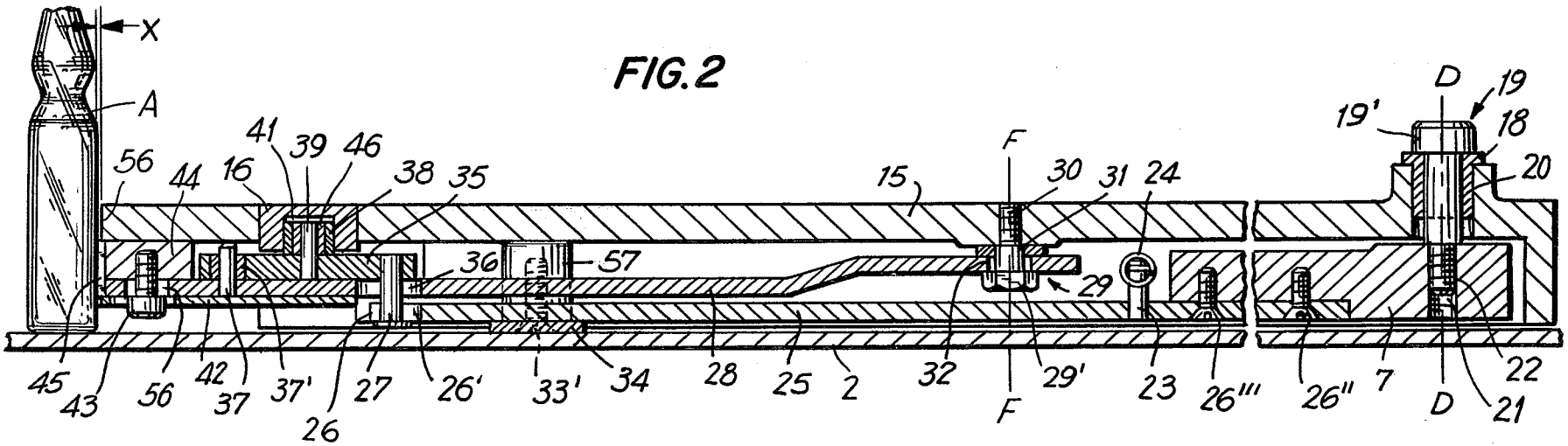
FIG. 2 is a vertical sectional view taken on line 2—2 of FIG. 1.

The transmission of motion between cam follower 4 and agitator bar 44 is obtained by operation of the anti-jammer means 55 which includes carrier arm 7, extension lever 25, link 35 and agitator carrier bar 28. As shown in FIG. 2, fastener 19 mounts carrier arm 7 for rotation with extension lever 25 about axis D-D. Fastener 19 includes a head portion 19' which engages and bears against flange 18 of bushing 20, a cylindrical shaft portion journalled in bushing 20 which is mounted in a passage formed in cover plate 15, and a threaded cylindrical portion 21 which threadedly engages a tapped hole 22 in carrier arm 7. Screws 26'',26''' pass with clearance through holes formed at one end of extension lever 25, and threadedly engage tapped holes formed in extension plate 18. A post 23 is provided adjacent screws 26'', 26''', and a return spring 24 has one end wrapped about post 23. The other end of extension lever 25 is bifurcated and has a pair of legs 26 bounding a slot 26'.

The elongated link 35 has an offset pin 27 which is fixedly mounted, e.g., by press-fit as shown in FIG. 2, at one end of the link 35 and which is located slightly off the longitudinal axis of the link 35. Offset pin 27 extends from link 35 through circular hole 36 formed in carrier bar 38 and continues into slot 26'. Sleeve 37' is mounted at the other end of the link 35 and is operative for receiving pivot pin 37 which is fixedly mounted, e.g., by press-fit, into agitator carrier bar 28.

A roller pin 39 is fixedly mounted, e.g., by press-fit intermediate the opposite ends of link 35. Pin 39 extends upwardly of link 35, and its projecting portion is journalled in sleeve 46 which is surrounded by fulcrum roller 38. Roller 38 is received in an elongated arcuate slot or track 41 which is formed in agitator guide member 16.

Figure 4:
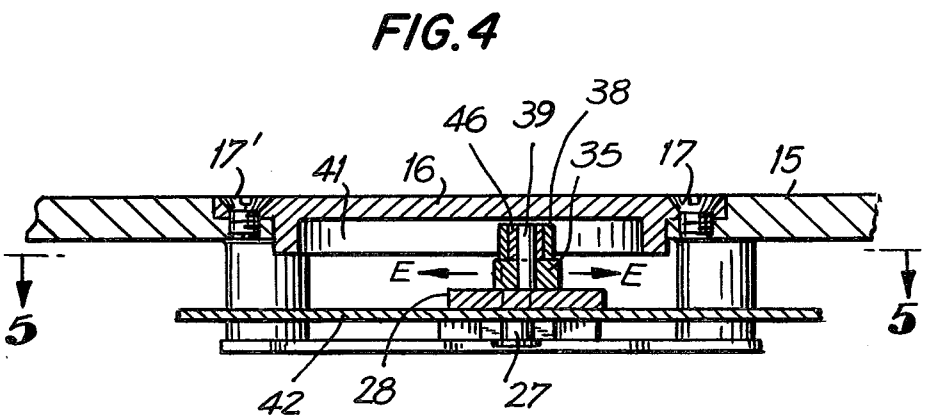
FIG. 4 is a vertical sectional view taken on line 4—4 of FIG. 1.

As best shown in FIG. 4, roller 38 is movable lengthwise of track 41 in direction of arrows E. Agitator guide member 16 is made as a separate piece and is connected to cover plate 15 by screws 17, 17'.

The agitator carrier bar 28 is elongated, and one end of carrier bar 28 is formed with an elongated slot 32. Fastener 29 includes a head portion 29' which engages the underside of carrier bar 28, a cylindrical shaft portion 31 which extends with clearance into slot 32, and a threaded portion 30 which threadedly engages a tapped hole formed in cover plate 15. Fastener 29 defines fixed axis F—F. Arcuate slot 41 has its center of curvature R on axis F—F.

A pair of elongated slots 56 is formed at the other end of carrier bar 28. Fastener screws 43 extend from mounting plate 42 through slots 56 and threadedly engage in tapped holes formed in agitator 44.

Agitator 44 is shaped as a segment of a circle, and its outer peripheral surface has its center of curvature R' on axis F—F. The outer surface of agitator 44 which faces the ampuls in chute 50 is provided with ampul-engaging portions or ridges 45. The outer surface need not necessarily be provided with ridges, because any roughened surface capable of grippingly engaging the ampuls would suffice. The agitator 44 is preferably made of synthetic plastic material in order to improve the gripping action. In FIG. 2, the ridges 45 are in engagement with the ampuls A, and the ridges 45 are shown as projecting away from the end wall 56 of the cover plate 15 by a distance x. According to a currently preferred embodiment, distance x is on the order of 0.020 inches.

A retaining plate 34 is mounted below the extension lever 25. Fastening screws 33, 33' are threaded into tapped holes formed in bosses 57 which extend downwardly from cover plate 15. The retaining plate 34 serves to support the extension lever 25 from below.

Figure 6:
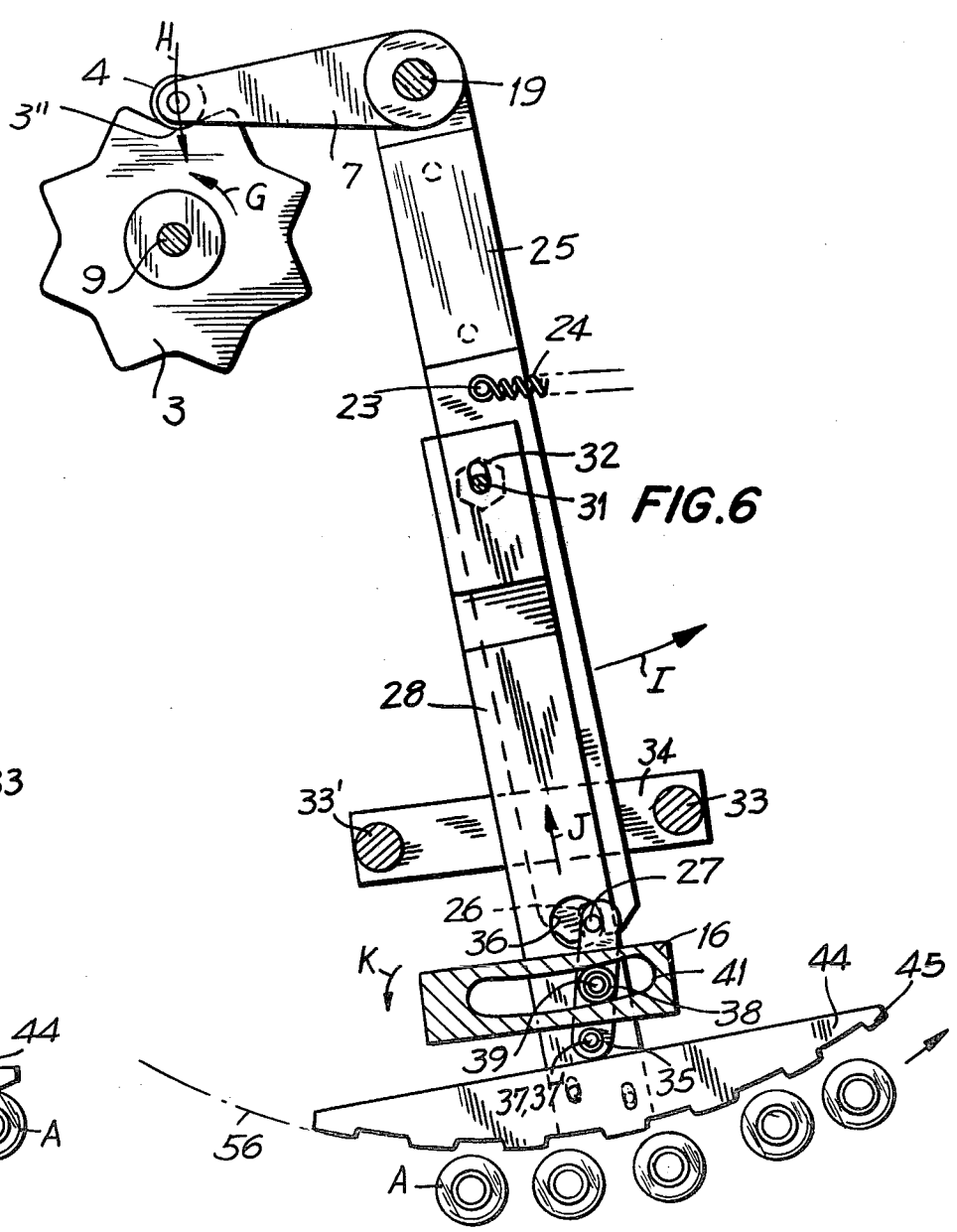
FIG. 6 is a view analagous to FIG. 5 and shows the device in another operating position.

The operation of the anti-jammer device may now be described with reference to FIGS. 5 and 6. As shaft 8 and its extension 9 rotate about axis C—C, cam 3 likewise rotates in circumferential direction of arrow G alternately and periodically between peaks 3' and valleys 3''. As shown in FIG. 6, roller 4 is located fully within valley 3'', and this means that carrier arm 7 has moved to its furthest extent downwardly in direction of arrow H. Inasmuch as arm 7 and extension lever 25 turn together about axis D—D as defined by pin 19, this means that lever 25 has moved to its furthest extent towards the right in direction of arrow I.

In the position of FIG. 6, legs 26 of lever 25 urge offset pin 27 against the rightmost portion of the inner circumferential wall of circular hole 36. This position of the offset pin 27 has caused link 35 to pivot about fulcrum roller 38, and concomitantly has caused agitator carrier arm 28 to be shifted in direction of arrow J until cylindrical shaft portion 31 is at the lowermost end of clearance slot 32. As also shown in FIG. 6, the longitudinal axis of link 35 is inclined relative to the longitudinal axis of agitator carrier arm 28, and the ridges 45 are either substantially flush with or spaced slightly inwardly of end wall 56 of cover plate 15 so that ampuls A are not engaged by the agitator 44.

As the roller 4 leaves its illustrated position in FIG. 6 and begins to climb up the next peak 3', the carrier arm 7 is turned in direction opposite to arrow H, and the extension lever 25 is turned in direction opposite to the arrow I against the force of the return spring 24. Legs 26 urge offset pin 27 generally towards the leftmost portion of the inner circumferential wall of circular hole 36 and, in turn, the link 35 is caused to pivot about fulcrum roller 38 and pivot pin 39 in direction of arrow K until the offset pin 27 engages the leftmost portion of the inner circumferential wall of circular hole 36, wherein the longitudinal axis of link 35 is substantially parallel to and in alignment with the longitudinal axis of carrier bar 28. Inasmuch as the fulcrum roller 38 surrounding pivot pin 39 is confined to travel in stationary track 41, the pivoting of the link 35 from its inclined orientation towards its aligned orientation causes the pivot pin 37 to move from a position closer to stationary track 41 to a position further away from track 41. This movement of pivot pin 37 causes the carrier bar 28 to shift downwardly in direction opposite to arrow J, i.e., radially outwardly as considered from the axis of curvature F—F into the path of the ampuls being guided through the guide chute 50.

Figure 5:
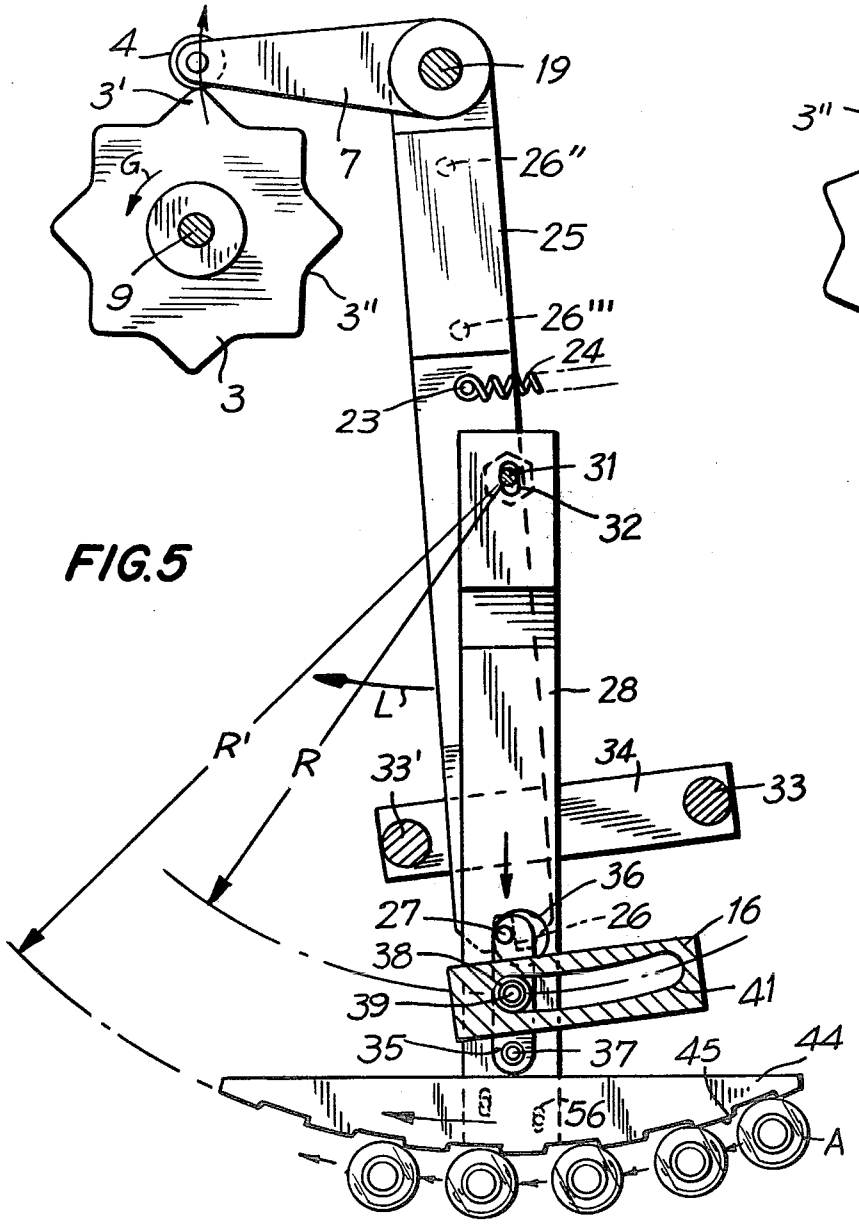
FIG. 5 is a top plan view of the interior components of the anti-jammer device of FIG. 1 as seen from line 5—5 of FIG. 4 and shows the device in one operating position.

As the roller 4 continues to climb up the peak 3', the legs 26 and offset pin 27 will urge carrier arm 28 towards the left in direction of arrow L until the fulcrum roller 38 engages the end wall of track 41, which is the position illustrated in FIG. 5 and which corresponds to roller 4 being at the apex of peak 3'.

As soon as roller 4 begins to descend from the apex of peak 3', extension lever 25 moves in direction opposite to arrow L, and legs 26 urge offset pin 27 back towards the rightmost portion of the inner circumferential wall of circular hole 36. This shifting of the offset pin causes link 35 to pivot about fulcrum roller 38 back to the previously described inclined orientation, and concomitantly causes pivot pin 37 to be moved closer to track 41, thereby retracting the carrier arm 28 in radially inward direction away from the path of ampul flow.

Subsequent movement of roller 4 towards the lowest position within valley 3" causes the legs 26 and offset pin 27 to urge carrier bar 28 in direction of arrow I until the fulcrum roller 38 reaches the position shown in FIG. 6. The return spring 24 facilitates this return movement.

Starting with the position of the agitator 44 in FIG. 6, the anti-jamming means 55 is operative initially for moving the agitator 44 radially outwardly in direction transversely of the path of ampul flow so as to engage ampuls in chute 50, then the agitator 44 is moved from the downstream portion 52 past throat portion 53 towards the upstream portion 51 of chute 50 so as to displace the engaged ampuls in countercurrent direction to the path of ampul flow, then the agitator 44 is moved radially inwardly so as to release its engagement with the ampuls in chute 50, and finally the agitator 44 is moved back towards its starting position underneath the cover plate 15 so as to be ready for another so-called "box-like" movement cycle.

The anti-jamming procedure described above continues in successive manner with a frequency dependent upon the number of peaks and valleys on the cam 3. Other cycles other than the "boxlike" cycle described above may also be used.

As shown in FIG. 2, the turntable 2 engages the bottoms of the ampuls at the downstream portion 53 of the infeed chute 50 and advances the ampuls towards my novel infeed shuttle arrangement.

INFEED SHUTTLE ARRANGEMENT (FIGS. 7–17)

Figures 8, 9, 10:
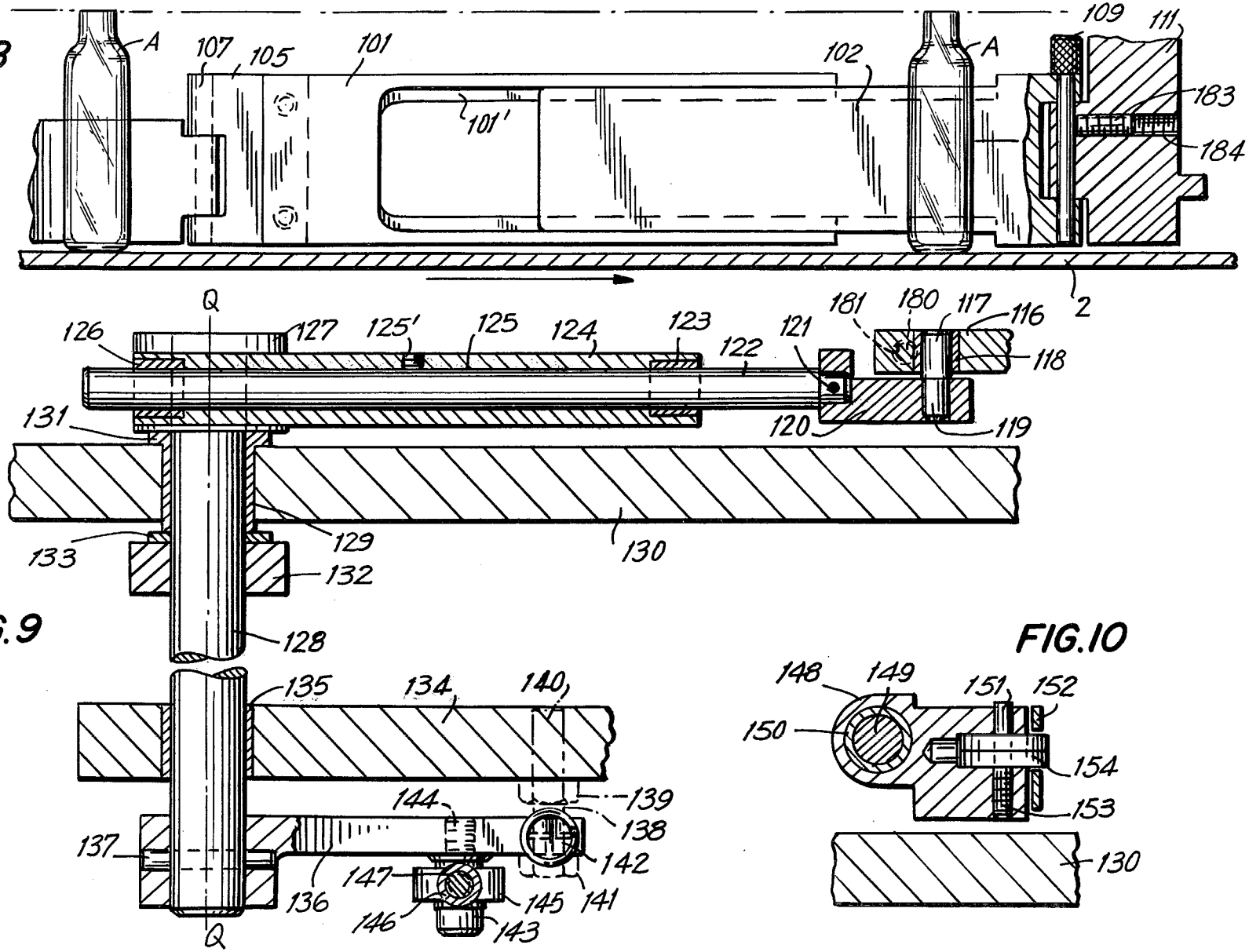
FIG. 8 is a vertical sectional view taken on line 8—8 of FIG. 7.
FIG. 9 is a vertical sectional view taken on line 9—9 of FIG. 7.
FIG. 10 is a vertical sectional view taken on line 10—10 of FIG. 7.
Figure 13:
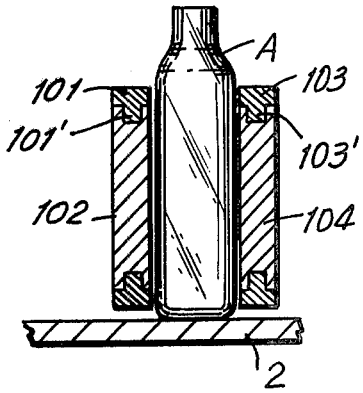
FIG. 13 is a vertical sectional view taken on line 13—13 of FIG. 7.

Referring now to FIG. 7, the infeed shuttle arrangement 100 comprises a pair of spaced apart channel side walls which together bound a passage for the ampuls to be fed through by the above-described frictional engagement with the rotary turntable 2. One channel side wall includes a first arm 101, and a second arm 102 which is mounted in telescoping relationship with its first arm 101, as best shown in FIG. 8. The other channel side wall includes a first arm 103, and a second arm 104 which is similarly mounted in telescoping relationship with its first arm 103. Hinges 105, 106 are mounted at fixed locations on the machine and are respectively connected to first arms 101, 103. Hinge pins 107, 108 respectively define fixed axes about which first arms 101, 103 are turnable in direction of arrows M. As best shown in FIG. 13, each first arm 101, 103 has longitudinal ribs 101', 103' of rectangular cross-section which mate in sliding telescoping relationship with complementary contoured recesses formed on each second arm 102, 104.

A pair of spaced apart gate members 111, 112 are pivotally connected by pivot pins 109, 110 to second arms 102, 104, respectively. The pivot pins are fixedly held in place; e.g., in FIG. 8, set screw 183 in tapped hole 184 formed in gate member 111 holds pin 9 in fixed position. Gate members 111, 112 together bound a passageway which communicates with and is inclined relative to the passage defined by the channel side walls.

Figure 11:
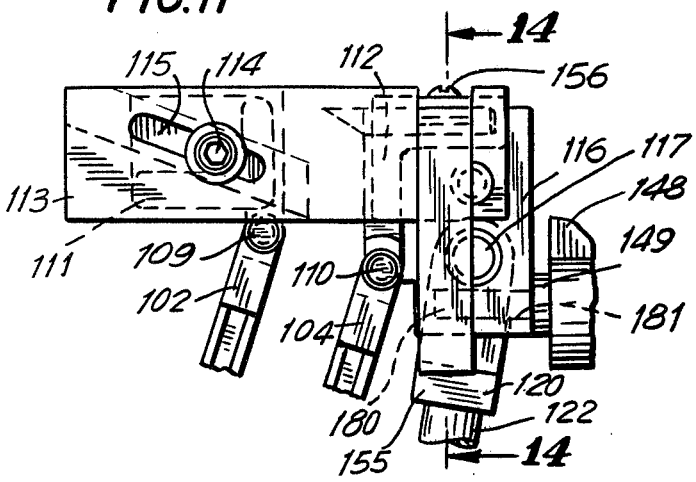
FIG. 11 is a top plan view of the downstream end of the infeed shuttle arrangement of FIG. 7.
Figure 12:
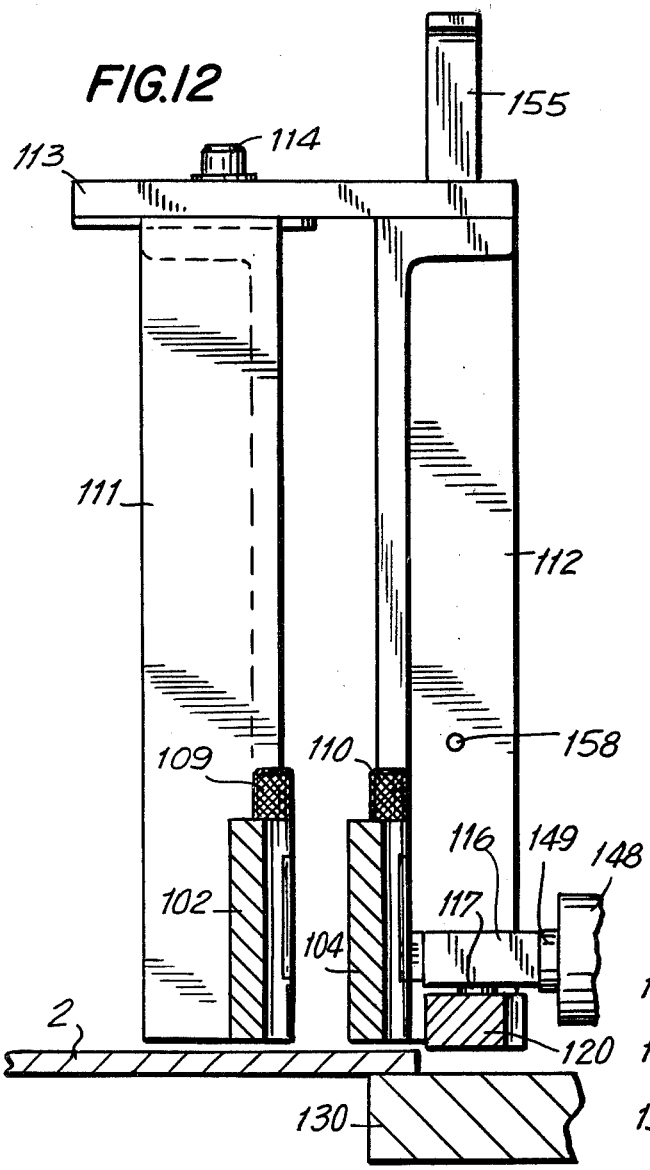
FIG. 12 is a vertical sectional view taken on line 12—12 of FIG. 7.
Figure 14:
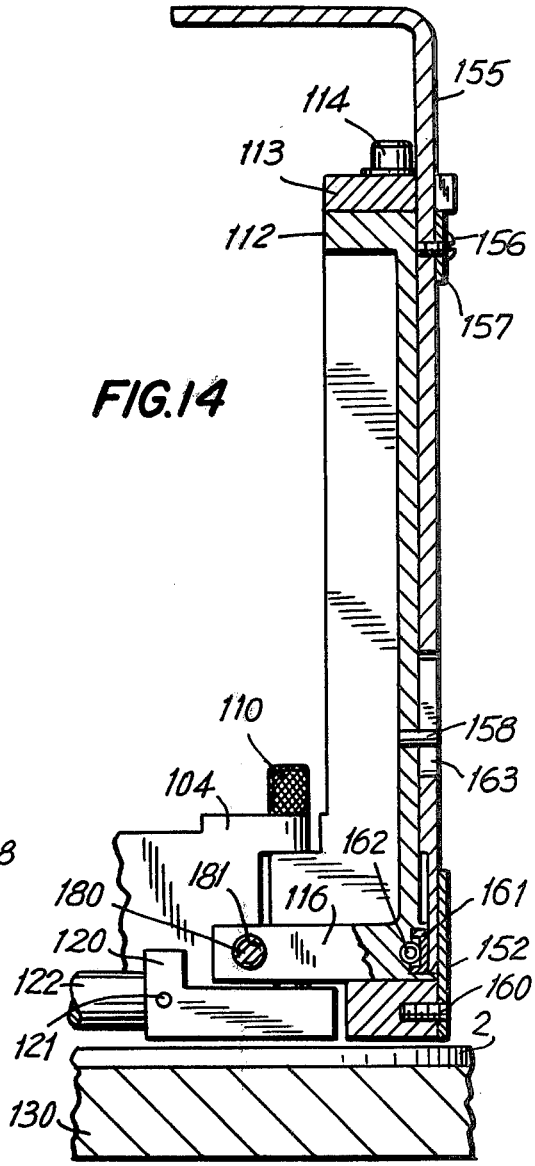
FIG. 14 is a vertical sectional view taken on line 14—14 of FIG. 11.

As best shown in FIGS. 11, 12 and 14, the top wall of gate member 111 is connected by adjustment screw 114 in elongated slot 115 to top plate 113 which also extends over the top wall of gate member 112. The lower wall 116 of gate member 112 has a tapped hole 181 which threadedly engages and is thereby connected to threaded rod portion 160 of guide rod 149. As best shown in FIG. 10, guide rod 149 is mounted within sleeve 150 which defines a guideway in stationary guide block 148. As will be described in detail below, the guide rod 149 is operative for guiding the gate members 111 and 112 in direction substantially parallel to the path of advancement of the intermittently-driven conveyor chain 175.

L-shaped bracket 155 has its short leg or handle portion extending over gate member 112, and its long leg mounted to gate member 112 by cooperation of screw 156 and retaining plate 157. Alignment pin 158 extends through a slot 163 formed in bracket 155. Bearing plate 152 is fixedly mounted to gate member 112 by set screw 160. U-shaped door member 161 and spring 162 are mounted at the lower end of gate member 112 behind the long leg of bracket 155 in direction away from bearing plate 152. Spring 162 preloads door member 161 and tends to urge it across the ampul line of advance. Bracket 155 is manually vertically movable between a down position in which the bracket engages door member 161 and prevents it from moving across the ampul line of advance, and an up position in which the bracket permits the spring 162 to move door member 161 across the ampul pathway. By raising or lowering the bracket 155, the door member 161 stops or permits ampuls to reach the conveyor pockets.

Referring again to FIG. 7, intermittent conveying means or intermittently-driven conveyor chain 175 is operative for advancing ampuls A along a path in direction of arrow P during advancement time periods (hereinafter $T_A$) in which the ampuls are conveyed from one workstation to the next successive workstation of the machine. Put another way, if ampuls have already been filled at the filling station, then the conveyor chain advances the filled ampuls to the sealing station during time $T_A$.

Intermediate each time $T_A$, the ampuls are being processed at their respective stations during processing or dwell time periods (hereinafter $T_p$). During each time $T_P$, the chain preferably does not advance. Put another way, the chain maintains the ampuls at their respective stations so that they can be filled and/or sealed during time $T_p$.

The conveyor chain 175 comprises a chain of links, alternate ones of which carry a laterally offset pair of rollers, two pairs of which are identified by reference numerals 177, 178. The links of the chain are entrained about non-illustrated sprocket wheels which are journalled below conveyor cover 176 to which antijammer device 1 is mounted by fastener arrangement 177'. The outer peripheries of the adjacent rollers form generally V-shaped recesses or ampul- receiving pockets, one of which is generally identified by reference numeral 179. The large open side of the pockets are closed by bearing plate 152 in the vicinity of gate member 112.

As shown in FIG. 10, spring-loaded guides 154 extend through bearing plate 152 and are journalled on mounting pins 151 that have threaded portions 153 which threadedly engage tapped holes in stationary block 148. Guides 154 bear against the ampuls and securely seat them against the conveyor rollers. A plurality of substantially flat plates, one of which is identified by reference numeral 185 in FIG. 7, is spring-loaded and provides a guiding surface which keeps the ampuls securely in the conveyor pockets.

A drive 190 is operative for moving the infeed shuttle 100 from the end limiting position diagrammatically illustrated in FIG. 15 to the end limiting position diagrammatically illustrated in FIG. 16 during each time $T_P$, and for thereupon moving the infeed shuttle 100 back towards the original end limiting position shown in FIG. 15 during each time $T_A$. The drive is also operative for moving the gate members 111, 112 in substantially parallel countercurrent direction to the path P during time $T_P$, and also for moving the gate members 111, 112 in substantially parallel downstream direction relative to the path P during time $T_A$.

As best shown in FIG. 9, the drive 190 includes a pivot pin 117 having a first portion journalled in bearing sleeve 118 which is mounted in lower wall 116 of gate member 112, and a second portion 119 journalled in a passage formed in L-shaped member 120.

A drive rod 122 has one end pinned by pin 121 to member 120 and is mounted for sliding movement within elongated passage 125 formed in drive block 124. Bearing sleeves 123 and 126 are mounted at opposite ends of passage 125.

Drive block 124 has a hub 127 which is fixedly mounted for rotation with shaft 128. Mounting bushing 129 extends through top mounting plate 130, and flange 131 supports the drive block 124. Washer 133 supports the bushing 129 above support 132.

Shaft 128 extends downwardly from top mounting plate 130 past intermediate plate or shelf 134 in which it is journalled for rotation about axis Q-Q by sleeve 135. The lower end of shaft 128 is fixedly mounted by set screw 137 to coupling member 136. Screw 141 has a threaded portion 140 in threaded engagement with shelf 134. Nut 139 locks screw 141 in fixed position relative to shelf 134. A return spring 142 has one end wrapped around screw 141 in the region 138 intermediate its head portion and threaded portion 140.

The opposite end of return spring 142 is connected to coupling member 136. Screw 143 has threaded portion 144 in threaded engagement with coupling member 136. Head portion 145 of lug 146 surrounds and is thereby connected to the intermediate portion of screw 143. One end of connecting rod 147 is connected to lug 146, and the opposite end of connecting rod 147 is connected to lug 170. Lug 170 may be driven by any reciprocating source of motive power. Conventionally, the reciprocating drive follows a specific cam contour which stimulates a geneva-type motion characteristic during the return stroke.

The operation of the infeed shuttle arrangement will not be explained with the aid of FIGS. 15–17. In these FIGS., the conveyor chain 175 has been diagrammatically illustrated as a row of rollers R0, R1, R2 . . . R6. The ampul-receiving pockets have been identified by reference numerals 1, 2, . . . 5. The ampuls being advanced through the infeed shuttle 100 are identified by reference characters A0, A1, A2 . . . A5.

FIG. 15 shows the relative orientation of infeed shuttle 100 and chain 175 at the start of a one second cycle in which it is desired to load four ampuls, namely A1, A2, A3, A4. The selection of "four" ampuls and of a "one second" cycle have been chosen merely for exemplary purposes and for ease of description. The invention is intended to include the loading of any number of ampuls in a cycle of any time duration.

Upon actuation of the source of motive power, the connecting rod 147 initially pushes the coupling member 136 towards the left in FIG. 7 against the force of return spring 142. In response thereto, the shaft 128 turns, and this movement is transmitted to pivot drive block 124 and drive rod 122. The movement of rod 122 is transmitted to the infeed shuttle 100 which moves in direction of arrow R. Gate members 111 and 112 are constrained to move in a countercurrent path substantially parallel to the path P due to the operation of the guiding means 148, 149. It will be noted that the passageway defined by gate members 111, 112 is always maintained substantially normal to the path P.

FIG. 16 shows the relative orientation of the infeed shuttle 100 and conveyor chain 175 at the end of time $T_P$ which is usually on the order of $\frac{3}{4}$ of a second for a one second cycle. The turntable 2 has loaded ampuls A1, A2, A3 in pockets 1, 2, 3 during time $T_P$. Chain 175 does not move during time $T_P$.

At the conclusion of time $T_P$, the conveyor chain now begins to advance. During time $T_A$, which is generally on the order of $\frac{1}{4}$ second, the connecting rod 147 pulls the coupling member 136 towards the right in FIG. 7 and is aided by the restoring force of the return spring 142. In response thereto, the shaft 128 turns, and this movement is transmitted to pivot drive block 124 in which drive rod 122 slides. Thus, the infeed shuttle is caused to move in direction of arrow S, as illustrated in FIG. 17.

It will be recognized from FIG. 17 that ampul A4 is loaded in pocket 4 on-the-fly, i.e., while chain 175 and gate members 111, 112 are all moving towards the right in downstream direction of the path P.

Furthermore, ampul A4 is loaded during essentially the major portion of time interval $T_A$. Ampul A4 is thus loaded at a slower relative speed and in about the same time as compared to ampuls A1–A3.

OUTFEED SHUTTLE ARRANGEMENT (FIGS. 18-23)

Figure 18:
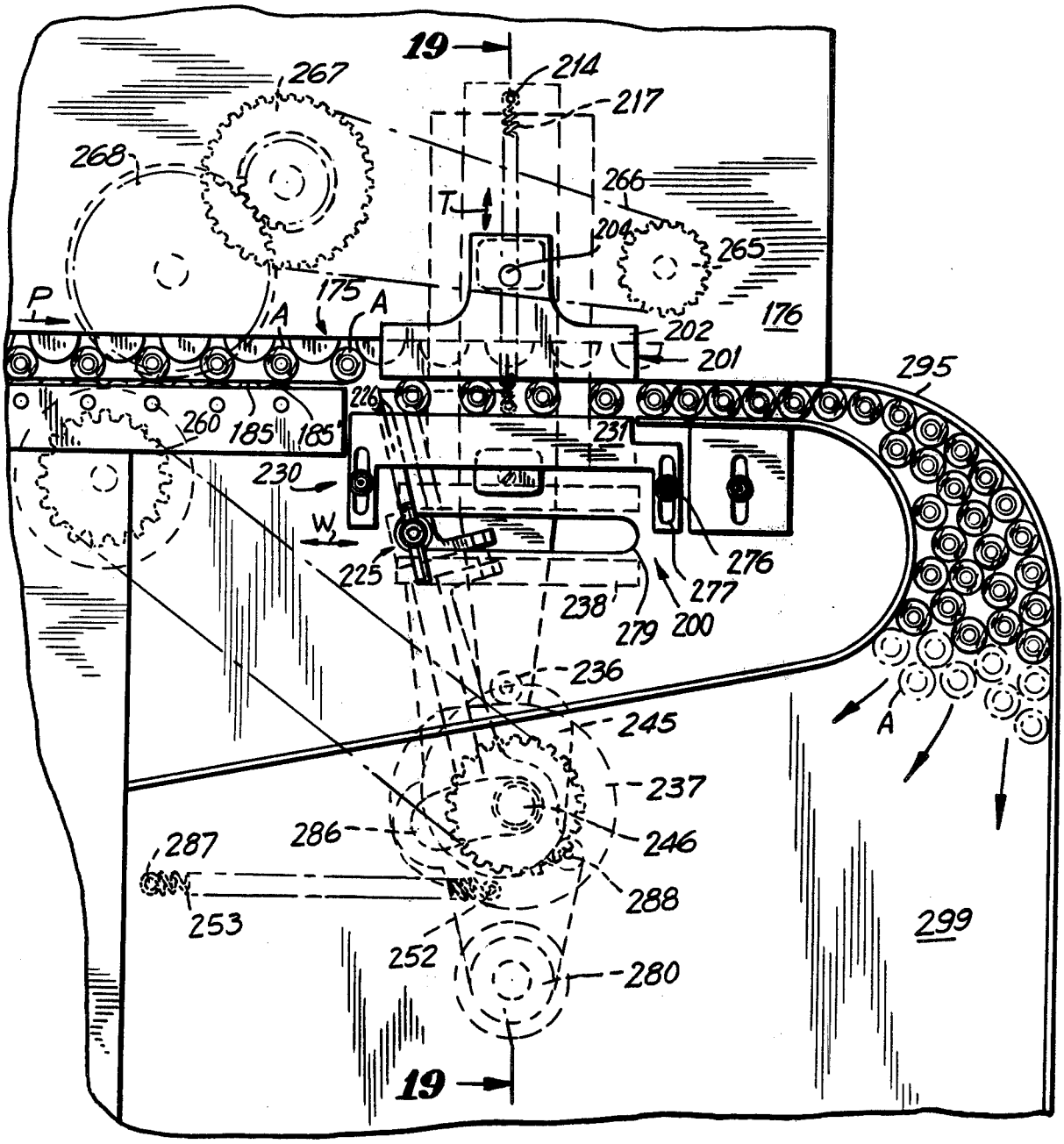
FIG. 18 is a fragmentary top plan view of the outfeed end of the ampul processing machine and shows an outfeed shuttle arrangement in top plan view according to the present invention.

Referring now to FIG. 18, the intermittently-driven conveyor chain 175 has already conveyed ampuls A along the path P during advancement time periods $T_A$ past the filling and/or sealing workstations when the ampuls were processed during dwell time periods $T_P$. The chain conveyor 175 continues to intermittently advance the ampuls towards an outfeed station, wherein an outfeed shuttle arrangement 200 is operative for discharging the ampuls during each dwell time period toward a discharge station from which the ampuls are unloaded. A plurality of substantially flat spring-loaded guide plates 185 are alternately mounted intermediate rollers 185'. Plates 185 prevent the ampuls from leaving the conveyor pockets during transport; rollers 185' are operative to rotate the ampuls registered at the sealing station in conventional manner so as to uniformly distribute the sealing heat to the periphery of the ampul neck.

Figure 19:
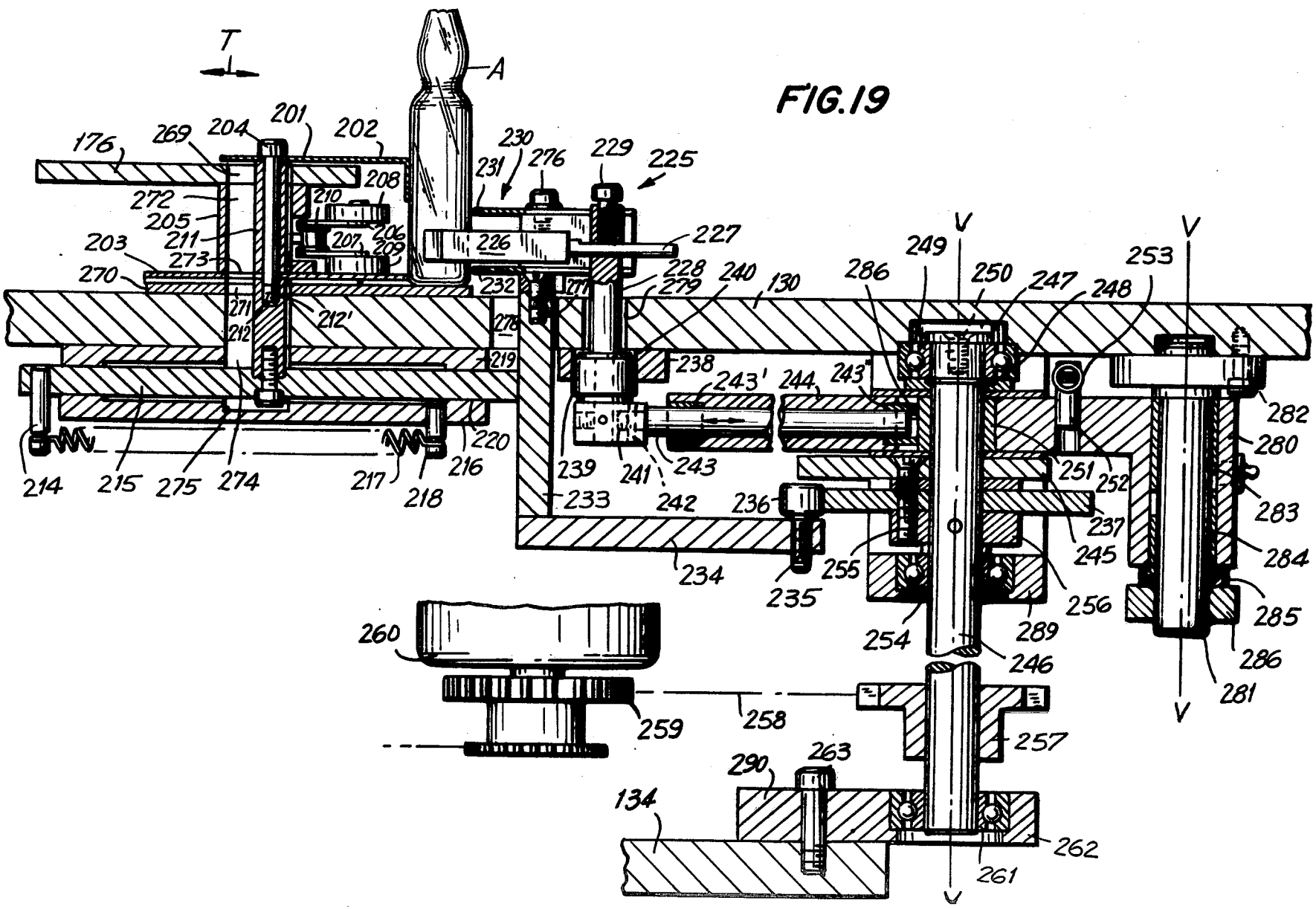
FIG. 19 is a vertical sectional view taken on line 19—19 of FIG. 18.

As best shown in FIG. 19, the conveyor 175 comprises a chain of links, each link 210 having a support from which a pair of laterally offset arms 206, 207 extend in mutually parallel relationship. A pair of rollers 208, 209 are mounted for rotation on arms 206, 207, respectively. The conveyor 175 is entrained about sprocket wheels, one of which is identified by reference numeral 265 in FIG. 18 and is journalled for rotation below conveyor cover 176. Sprocket wheel 265 is driven by chain belt 266 and by transmission gears 267, 268 which are in turn driven by motor 260. Cover 176 is supported by support post 205.

The outfeed shuttle arrangement 200 comprises a first shuttle member or pusher 201, a second shuttle member or guide block 230 which is spaced from pusher 201 and which bounds an elongated channel therewith, and a sweeper assembly 225 having a movable wiper arm 226.

Pusher 201 includes an upper L-shaped element 202 and a lower element 203. Spacer post 211 spaces the upper element 202 from the lower element 203 by a predetermined distance, and screw 204 extends through holes formed in both elements 202, 203 and secures the elements in fixed position relative to each other when its threaded portion 212 is fully tightened in tapped hole 212' provided in post 211. As best shown in FIG. 19, the shorter leg of L-shaped element 202 engages a side wall of an ampul over a portion of the length thereof, and the lower element 203 engages the ampul in the vicinity of its bottom wall.

The pusher 201 is mounted on movable carriage plate 215 for movement in direction of arrows T by screw 213 which passes through plate 215 and threadedly engages a tapped hole in post 211. Carriage guide plates 216, 219 together bound a slide track 220 along which carriage plate 215 slides. In order to accommodate such sliding movement, cover plate 176 is provided with slot 269; support post 205 is provided with slot 272; base plate 270 on which the bottom walls of the ampuls are supported is provided with slot 271; top mounting plate 130 is provided with slot 274; and carriage guide plates 216, 219 are provided with slot 275.

A post 214 is fixedly mounted at one end of carriage plate 215, and another post 218 is fixedly mounted in lower guide plate 216 which is stationarily mounted with respect to top mounting plate 130. Return spring 217 has its opposite ends wrapped around posts 213, 218.

The guide block 230 includes an upper abutment plate 231 and a lower abutment plate 232 interconnected to each other by screws 276 which respectively extend through slots 277. Abutment elements 231, 232 are spaced from each other and are located on the opposite side of the ampul which is away from pusher elements 202, 203. A wiper arm 226 extends through the lateral space bounded by abutment elements 231, 232 towards a position laterally adjacent the outer peripheral wall of the ampul. Arm 226 has an extension rod 227 which is held in fixed position relative to rod holder 228 by set screw 229.

Screw 277 fixedly connects block 230 to vertical carriage plate 233 which is connected, e.g. by threaded connection, to horizontal carriage plate 215. Slot 278 is formed in top mounting plate 130, and grants clearance for movement of the vertical plate 233 in direction of the arrows T.

It will be recognized that abutment elements 231, 232 of block 230 and pusher elements 202, 203 of pusher 201 are all movable together as a unit, because the block 230 and the pusher 201 are respectively mounted on interconnected carriage plates 233 and 215, and because both of these carriage plates are in turn connected to displaceable plate 234. Plate 234 has a cam follower 236 which is fixedly mounted on plate 234 by threaded rod 235. Cam 237 has an uneven outer cam surface on which cam follower 236 rides. Cam 237 is fixedly mounted on drive shaft 246 for rotation with the latter by axis U-U. Drive gear 257 is likewise fixedly mounted on shaft 246 for rotation with the latter about axis U-U. Electric motor 260 drives output gear 259 which in turn drives drive gear 257 through a coupling arrangement, e.g., chain drive 258.

Wiper arm 226 is movable between end limiting positions lengthwise of slot 279 in directions of arrows W (see FIG. 18). Rod holder 228 extends through slot 279 with clearance, and guide roller 239 which is mounted on rod holder 228 is slidingly received in track 240 of stationary block 238 mounted below top mounting plate 130.

Wiper arm 226 is movable by sweeper plate 244 which has a rod-shaped member 243 formed with a threaded rod portion 242. Rod portion 242 threadedly engages the tapped hole in connecting member 241. Rod member 243 is mounted for reciprocating movement in direction of the illustrated double-headed arrow by sleeves 243', 243" and permit wiper arm 226 to move substantially parallel to the conveyor path. Connecting member 241 is fixedly connected to the lower end of rod holder 228. The opposite cylindrically shaped end region 280 of sweeper plate 244 is pivotally mounted on stub shaft 281 for turning movement about axis V-V. Shaft 281 is fixedly mounted to top plate 130 by screw 282, and the turning movement of sweeper plate 244 about shaft 281 is facilitated by sleeve 283, bushing 284 and washer 285 which engages support 286.

Intermediate rod-shaped end region 243 and cylindrically shaped end region 280, an arcuate slot 286 is formed in sweeper plate 244. Drive shaft 246 and sleeve 251 are accommodated in slot 286 which permits the sweeper plate 244 to move relative to the drive shaft 246 without interference therewith.

A post 252 is fixedly secured in plate 244, and one end of return spring 253 is wrapped around post 252. Stationary post 286 is connected to the other end of spring 253.

Cam follower 288 is fixedly mounted on plate 244 and rides along the outer uneven cam surface of cam 245. Cam 245 like cam 237 is mounted on drive shaft 246 for rotation therewith about axis U-U. Screw 255 extends through cams 245, 237 into collar 256 and fixes the relative position of cams 245 and 237, thereby fixing the timing between the movement of the sweeper assembly 225 and of the pusher 201 and block 230, as will be described in detail below.

Anti-friction bearing 254 journals shaft 246 in support 289; anti-friction bearing 249 journals shaft 246 at one end region thereof intermediate collar 248 and flange 247 which is mounted on shaft 246 by screw 250; and anti-friction bearing 261 journals the opposite end region of shaft 246 in plate 290 which is connected to shelf 134 by screw 263.

The operation of the outfeed shuttle arrangement will now be described with reference to FIGS. 20–23. In these figures, the rollers of the conveyor chain 175 are diagrammatically represented as R1, R2, R3 . . . R9. The ampuls to be discharged towards discharge chute 295 are diagrammatically represented as A1, A2, A3 . . . A8. For exemplary purposes and for ease of description only, the operation of the outfeed shuttle arrangement will be described for discharge of "four" ampuls during a time cycle for the conveyor chain 175 of "one second." It will be understood that the invention is intended to cover the discharge of any number of ampuls during a time interval of any duration.

At the beginning of a cycle, chain 175 advances during an advancement time period ($T_A$), which is generally on the order of ¼ second, thereby advancing ampuls A1, A2, A3, and A4 along path P to the outfeed station intermediate pusher 201 and block 230. Cam follower 236 and cam 237 have already shifted carriage plates 234, 233 and 215 towards the left in FIG. 19 against the force of spring 217 until pusher elements 202, 203 are behind the rollers 208, 209, i.e., the rollers project beyond the pusher elements to an extent sufficient not to cause any interference between the advancing ampuls and the pusher elements.

During the next dwell time period ($T_P$), which is generally on the order of ¾ second, cam follower 236 and cam 237 are operative to shift carriage plates 234, 233 and 215 towards the right in FIG. 19 aided by the restoring force of return spring 217 until the pusher 201 engages the ampuls A1–A4 and pushes these ampuls away from the rollers R1–R5 to a position offset from the path P. Block 230 moves together with pusher 201 and acts as a backstop for the ampuls A1–A4.

Figure 20:
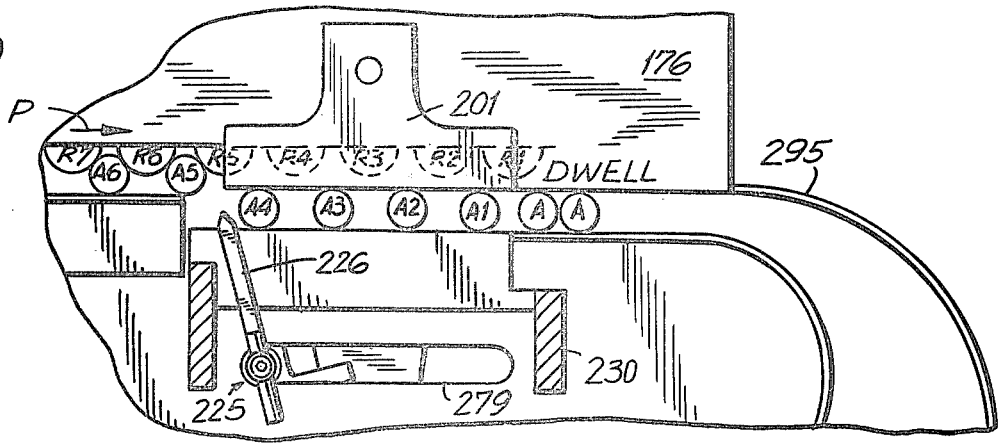
FIG. 20 is a fragmentary top plan view of the outfeed shuttle arrangement of FIG. 18 and shows the outfeed shuttle arrangement of one operating position.

FIG. 20 shows the relative orientation of pusher 201, block 230, sweeper 223 and ampuls A1–A4 in this above-described position offset from path P. Cam follower 288 and cam 245 have already displaced sweeper plate 244, and rod holder 228 has been moved to the leftmost end limiting position within slot 279. The tip of wiper arm 226 extends beyond the abutment elements 231, 232 in adjacent relationship relative to ampul A4.

Figure 21:
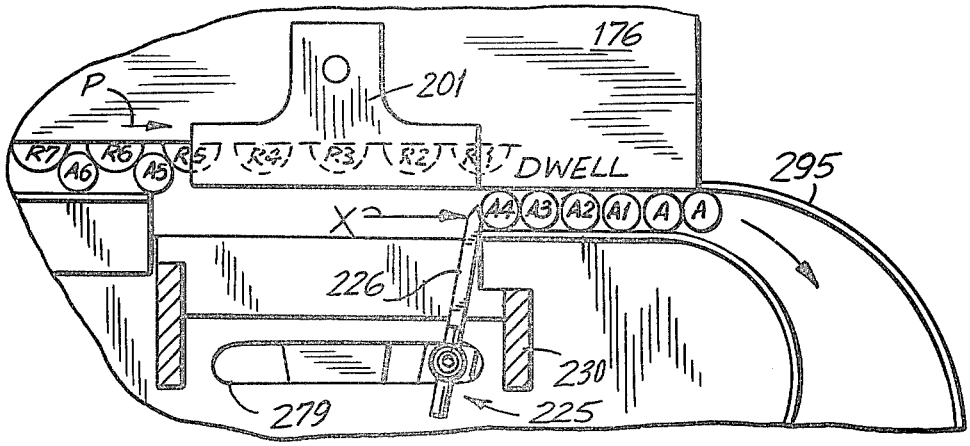
FIG. 21 is a view analagous to FIG. 20 and shows the outfeed shuttle arrangement in another operating position.

Starting from the position of FIG. 20, the cam 245 is now driven against the force of return spring 253 by motor 260 and drive shaft 246 to cooperate with cam follower 288 to pivot sweeper plate 244 about axis V—V until rod holder 228 has moved from its leftmost position shown in FIG. 20 to its rightmost position shown in FIG. 21. During this pivoting movement, wiper arm 226 engages ampul A4 and successively urges the latter against ampuls A3, A2 and A1. In other words, arm 226 sweeps all of the ampuls in direction of arrow X in FIG. 21 in a single stroke motion towards the discharge chute 295. Any previously discharged ampuls within chute 295 are displaced laterally and downstream of the ampul flow during the stroke of wiper arm 226. Cam follower 236 and cam 237 do not move pusher 201 and block 230 during this pivoting movement of the wiper 225. The chain 175 is still in its dwell time period.

Figure 22:
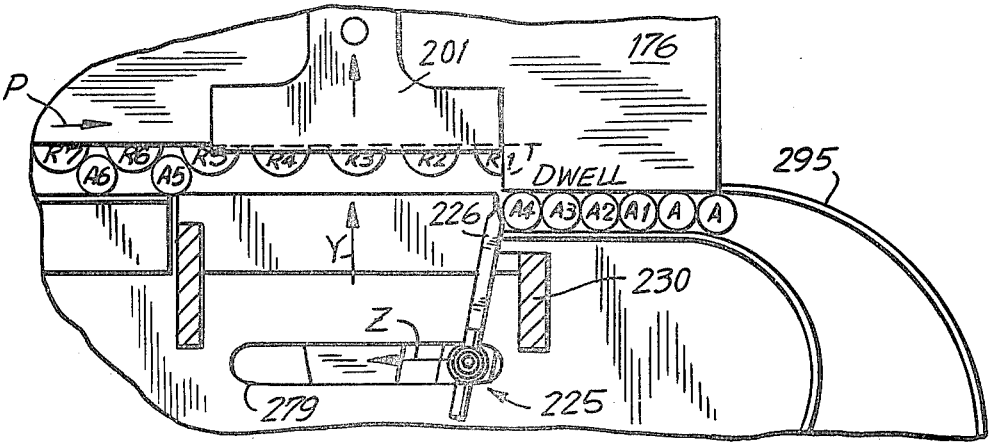
FIG. 22 is a view analagous to FIG. 20 and shows the outfeed shuttle arrangement in still another operating position.
Figure 23:
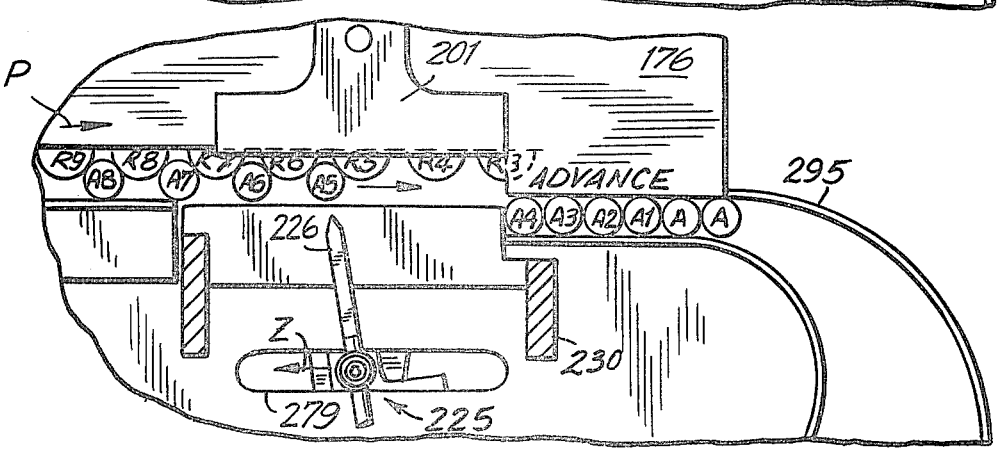
FIG. 23 is a view analagous to FIG. 20 and shows the outfeed shuttle arrangement in yet another operating position.

At this point, cam follower 236 and cam 237 are operative to shift pusher 201 from its extended position, as illustrated in FIGS. 20 and 21, in which the pusher elements 202, 203 project beyond the chain rollers to their retracted position, as illustrated in FIG. 22, in which the chain rollers are partially uncovered, thereby granting a clear passage for the next set of ampuls A5–A8 to be discharged. Simultaneously, cam follower 236 and cam 237 are operative to shift block 230 in direction of arrow Y from its unscreened in position which the tip of wiper arm 226 extends past the abutment elements 231, 232 towards its screened position, as shown in FIG. 22, in which the tip of wiper arm 226 is hidden behind the abutment elements 231, 232. The chain 175 is still in its dwell time period, and sweeper 225 has remained in its rightmost position in slot 279.

Now, drive 260 is operative to turn cam 245 being aided by return spring 253. Cam 245 and its follower 288 pivot sweeper plate 244 back towards its original starting position in direction of arrow Z. As rod holder 228 moves to its leftmost end limiting position in slot 279, chain conveyor 175 enters its time period $T_A$ and begins to advance. The advancing conveyor advances the next set of ampuls A5–A8 into position within the outfeed station, now unblocked by the tip of wiper arm 226. Pusher 201 and block 230 do not move until the last ampul A8 has been registered within the outfeed station.

The pusher 201 and block 230 are timed to begin to move the registered ampuls away from chain 175 when the rod holder 228 is still spaced a short distance away from the leftmost end of slot 279. When the rod holder 228 reaches the leftmost end of slot 279, as shown in FIG. 20, the pusher 201 and block 230 have already finished moving the registered ampuls their maximum distance away from the path P.

The aforementioned operational cycle then repeats itself for each time period $T_A$ and $T_P$. The ampuls are thus always discharged in a single continuous stroke during each dwell time period towards the discharge chute 295. Discharge chute 295 flares outwardly as considered in direction of ampul flow. Previously discharged ampuls are displaced laterally and downstream towards the discharge station 299 where unloading occurs.

It will be understood that each of the elements described above, or two or more together, may also find a useful application in other types of constructions differing from the types described above.

While the invention has been illustrated and described as embodied in arrangements for and methods of improving ampul handling capability in ampul processing machines, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, farily constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended

1. In an ampul processing machine, a combination comprising:

(a) means for guiding ampuls along a path, said guiding means including an upstream portion having a predetermined width transversely of the path, a downstream portion having a transverse width less than the predetermined transverse width of said upstream portion, and a throat portion intermediate said upstream and downstream portions and having a transverse width less than the predetermined width of said upstream portion but greater than the transverse width of said downstream portion, said upstream, throat and downstream portions all converging in smooth continuous manner downstream of the path; and (b) anti-jamming means for preventing ampuls being guided through said guiding means from jamming generally transversely across the path to thereby bridge and block the same, said anti-jamming means including a movable agitator adjacent said guiding means, and means for initially moving said agitator in a first direction generally transversely across the path between a retracted position away from the path towards an extended position in which said agitator projects partially transversely across the path to thereby engage ampuls being guided along the same, and for subsequently moving said agitator in a second direction generally upstream of the path while the agitator remains in its extended position from one end operating position adjacent said downstream portion towards another end operating position adjacent said upstream portion to thereby displace ampuls engaged by said agitator in countercurrent direction of the path, whereby ampul jamming and bridging across the path is counteracted.

2. The combination of claim 1, wherein said agitator has ampul-engaging portions facing said guiding means.

3. In an ampul processing machine, a combination comprising:

(a) means for guiding ampuls along a path, said guiding means including an upstream portion having a predetermined width transversely of the path, a downstream portion having a transverse width less than the predetermined transverse width of said upstream portion, and a throat portion intermediate said upstream and downsteam portions and having a transverse width less than the predetermined width of said upstream portion but greater than the transverse width of said downstream portion, said upstream, throat and downstream portions all converging in smooth continuous manner downstream of the path; and (b) anti-jamming means for preventing ampuls being guided through said guiding means from jamming generally transversely across the path to thereby bridge and block the same, said anti-jamming means including a movable agitator adjacent said guiding means, and means for moving said agitator between a retracted position away from the path towards an extended position in which said agitator projects partially transversely across the path to thereby engage ampuls being guided along the same, and for moving said agitator while the latter remains in its extended position from one end operating position adjacent said downstream portion towards another end operating position adjacent said upstream portion to thereby displace ampuls engaged by said agitator in countercurrent direction of the path, said moving means including means for supporting said agitator, means for shifting said agitator between its extended and retracted positions, and means for pivoting said agitator between its operating positions, whereby ampul jamming and bridging across the path is counteracted.

4. The combination of claim 3, wherein said supporting means is an elongated support having one end region mounted to said agitator, another end region formed with a clearance slot, and a pivot member mounted on said support intermediate said end regions thereof.

5. The combination of claim 4; and further comprising a stationary guide having an elongated track; and wherein said shifting means is an elongated link having a mating pivot member at one end region thereof operatively connected to said pivot member on said support to thereby form a pivot connection therewith, an offset pin at the other end region operatively connected to said pivoting means, and a fulcrum member mounted on said link intermediate said end regions thereof and mounted for movement along said track, said pivoting means being operative for displacing said offset pin in circumferential direction about said fulcrum member and for concomitantly displacing said pivot connection relative to said stationary guide in opposite circumferential direction about said fulcrum member.

6. The combination of claim 5, wherein said support has wall portions bounding an opening having opposite sides, and wherein said offset pin extends through said opening with clearance sufficient to permit said offset pin to be displaced by said pivoting means to said opposite sides of said opening.

7. The combination of claim 5; and further comprising a stationary member, and a mounting member connected to said stationary member and extending through said clearance slot with clearance sufficient to permit said support to be shifted by said shifting means in response to operation of said pivoting means.

8. The combination of claim 5, wherein said pivoting means is an elongated bar having legs bounding a slot through which said offset pin extends.

9. The combination of claim 3; and further comprising a rotary cam having an uneven cam surface, a movable cam follower ridable along said cam surface, and support means for mounting said cam follower for movement relative to said cam surface, said support means being operatively connected to said pivoting means and turning the latter in response to such movement relative to said cam surface.

10. A method of preventing ampuls being advanced along a continuously converging path in an ampul processing machine from jamming in direction generally transversely of the path and from thereby bridging and blocking the same, the method comprising the steps of:

(a) positioning an agitator adjacent the path of ampul advance;

(b) engaging the ampuls being advanced along the path by initially moving the agitator in a first direction generally transversely across the path from a retracted position remote from the path towards an extended position in which the agitator projects partially transversely across the path; and (c) displacing the ampuls engaged by the agitator in countercurrent direction of the path by subsequently moving the agitator in a second direction generally upstream of the path while the agitator remains in its extended position from a downstream portion of the path towards an upstream portion of the path.

11. In an ampul processing machine having successive work stations arranged along a path, a combination comprising:

(a) intermittent conveying means for advancing ampuls along the path during advancement time periods in which the ampuls are conveyed from one work station towards the next, and for maintaining the conveyed ampuls within their respective work stations for processing the ampuls during dwell time periods which alternate with said advancement time periods; and (b) means for continuously feeding at least one ampul to said intermittent conveying means during each dwell time period, and for continuously feeding at least one additional ampul to said intermittent conveying means during each advancement time period to thereby utilize both time periods of each operating cycle of the conveying means, whereby the ampul handling capability of the machine is increased.

12. In an ampul processing machine having successive work stations arranged along a path, a combination comprising:

(a) intermittent conveying means for advancing ampuls along the path during advancement time periods in which the ampuls are conveyed from one work station towards the next, and for maintaining the conveyed ampuls within their respective work stations for processing the ampuls during dwell time periods which alternate with said advancement time periods; and (b) means for feeding ampuls to said intermittent conveying means during each dwell time period to thereby increase the ampul handling capability of the machine, said feeding means including a movable infeed shuttle and means for moving said infeed shuttle between end-limiting positions in countercurrent direction of the path during each dwell time period.

13. The combination of claim 12, wherein said infeed shuttle includes a pair of spaced apart channel side walls bounding a passage for ampuls to be fed through, and hinge means for mounting said side walls for turning movement about fixed axes, said moving means being operative for pivoting said channel side walls about said axes.

14. The combination of claim 13, wherein said infeed shuttle further includes a pair of spaced apart gate members bounding a passageway which communicates with said passage and which extends generally normally of the path, each gate member being pivotally connected to a respective channel side wall.

15. The combination of claim 14, wherein each channel side wall has a first arm mounted to said hinge means, and a second arm pivotally connected to a respective gate member and mounted in sliding telescoping relationship with said first arm.

16. The combination of claim 14, wherein said feeding means further includes means for guiding said gate members in direction substantially parallel to the path, including a stationary block having a guideway extending generally parallel to the path, and a guide rod mounted in sliding relationship in the guideway and operatively connected to one of said gate members.

17. The combination of claim 12, wherein said moving means includes a pivotable drive member having an elongated passage, and a drive rod mounted in sliding relationship in the elongated passage and being operatively pivotally connected to said infeed shuttle.

18. In an ampul processing machine having successive work stations arranged along a path, a combination comprising:

(a) intermittent conveying means for advancing ampuls along the path during advancement time periods in which the ampuls are conveyed from one work station towards the next, and for maintaining the conveyed ampuls within their respective work stations for processing the ampuls during dwell time periods which alternate with said advancement time periods; and (b) means for feeding ampuls to said intermittent conveying means during each dwell time period to thereby increase the ampul handling capability of the machine, said feeding means also being operative for feeding ampuls to said intermittent conveying means during each advancement time period, said feeding means including a movable infeed shuttle and means for moving said infeed shuttle between one end-limiting position and another end-limiting position in countercurrent direction of the path during each dwell time period, and for moving said infeed shuttle between said other end-limiting position and said one end-limiting position downstream of the path during each advancement time period.

19. The combination of claim 18, wherein said moving means includes a reciprocably-driven drive member.

20. A method of feeding ampuls in an ampul processing machine, comprising the steps of:

(a) advancing ampuls along a path in which work stations are successively arranged during advancement time periods in which the ampuls are conveyed from one work station to the next;

(b) maintaining the conveyed ampuls within their respective work stations for processing the ampuls during dwell time periods which alternate with the advancement time periods; and (c) continuously feeding at least one ampul to the path during each dwell time period, and for continuously feeding at least one additional ampul to the path during each advancement time period to thereby utilize both the advancement and the dwell time periods, whereby the ampul handling capacity of the machine is increased.

21. The combination of claim 20, wherein said feeding step includes feeding ampuls to the path during each advancement time period.

22. A method of feeding ampuls in an ampul processing machine, comprising the steps of:

(a) advancing ampuls along a path in which work stations are successively arranged during advancement time periods in which the ampuls are conveyed from one work station to the next, said advancing step including advancing ampuls at substantially zero speed during each dwell time period and at a predetermined speed during each advancement time period;

(b) maintaining the conveyed ampuls within their respective work stations for processing the ampuls during dwell time periods which alternate with the advancement time periods; and (c) feeding ampuls to the path during each dwell time period to thereby increase the ampul handling capacity of the machine, said feeding step including feeding ampuls to the path during each advancement time period, said step of feeding ampuls to the path during each advancement time period being performed at a first speed differential relative to said predetermined speed, and said step of feeding ampuls to the path during each dwell time period being performed at a second speed differential relative to said zero speed which is less than said first speed differential.

23. In an ampul processing machine having successive work stations arranged along a path, a combination comprising:

(a) intermittent conveying means for advancing ampuls in spaced-apart relationship along the path during advancement time periods in which the ampuls are conveyed from one work station towards the next, and for maintaining the conveyed ampuls within their respective work stations for processing the ampuls during dwell time periods which alternate with said advancement time periods; and (b) means for discharging ampuls from said intermittent conveying means during each dwell time period by initially moving the ampuls to be discharged in their spaced-apart relationship away from the conveying means, and by subsequently moving the ampuls to be discharged to a closed contiguous relationship prior to moving all of the ampuls to be discharged in their contiguous relationship downstream of the path to thereby increase the ampul handling capability of the machine.

24. The combination of claim 23, wherein said discharging means includes a movable outfeed shuttle having an outfeed elongated passage, and means for moving said outfeed shuttle in direction transversely of the path between an aligned and an offset position in which said outfeed passage is respectively in alignment with and remote from the path.

25. The combination of claim 24, wherein said discharging means includes a pusher and a guide block at opposite lateral sides of said passage, and wherein said moving means includes a movable carriage on which both said pusher and block are mounted.

26. In an ampul processing machine having successive work stations arranged along a path, a combination comprising:

(a) intermittent conveying means for advancing ampuls along the path during advancement time periods in which the ampuls are conveyed from one work station towards the next, and for maintaining the conveyed ampuls within their respective work stations for processing the ampuls during dwell time periods which alternate with said advancement time periods; and (b) means for discharging ampuls from said intermittent conveying means during each dwell time period to thereby increase the ampul handling capability of the machine, said means including a movable outfeed shuttle having an outfeed elongated passage, and means for moving said outfeed shuttle in direction transversely of the path between an aligned and an offset position in which said outfeed passage is respectively in alignment with and remote from the path and including a displaceable wiper arm extending generally in direction transversely of the path, and means for displacing said wiper arm between end-limiting positions lengthwise of said outfeed passage.

27. The combination of claim 26; and further comprising timing means for halting movement of said outfeed shuttle in its offset position when said wiper arm is located at one of its end limiting positions in which it projects into an upstream region of said outfeed passage, and for maintaining said outfeed shuttle in its offset position until said wiper arm is located at the other one of its end limiting positions.

28. The combination of claim 26; and further comprising timing means for initiating movement of said outfeed shuttle to its aligned position when said wiper arm is located at one of its end limiting positions in which it projects into a downstream region of said outfeed passage, and for thereupon initiating movement of said wiper arm to the other one of its end limiting positions.

29. A method of discharging ampuls from an ampul processing machine, comprising the steps of:

(a) advancing ampuls along a path in which work stations are successively arranged during advancement time periods in which the ampuls are conveyed in spaced-apart relationship from one work station to the next;

(b) maintaining the conveyed ampuls within their respective work stations for processing the ampuls during dwell time periods which alternate with the advancement time periods; and (c) discharging ampuls from the path during each dwell time period by initially moving the ampuls to be discharged in their spaced-apart relationship away from the path, and by subsequently moving the ampuls to be discharged to a closed contiguous relationship prior to moving all of the ampuls to be discharged in their contiguous relationship downstream of the path to thereby increase the ampul handling capacity of the machine.

30. In an ampul processing machine having successive work stations arranged along a path, a combination comprising:

(a) intermittent conveying means for advancing ampuls in spaced-apart relationship along the path during advancement time periods in which the ampuls are conveyed from one work station towards the next, and for maintaining the conveyed ampuls within their respective work stations for processing the ampuls during dwell time periods which alternate with said advancement time periods;

(b) means for continuously feeding at least one ampul to said intermittent conveying means during each dwell time period, and for continuously feeding at least one additional ampul to said intermittent conveying means during each advancement time period to thereby utilize both time periods of each operating cycle of the conveying means; and (c) means for discharging ampuls from said intermittent conveying means during each dwell time period by initially moving the ampuls to be discharged in their spaced-apart relationship away from the conveying means, and by subsequently moving the ampuls to be discharged to a closed contiguous relationship prior to moving all of the ampuls to be discharged in their contiguous relationship downstream of the path, whereby the ampul handling capability of the machine is improved.

31. In an ampul processing machine having successive work stations arranged along a path, a combination comprising:

(a) intermittent conveying means for advancing ampuls along the path during advancement time periods in which the ampuls are conveyed from one work station towards the next, and for maintaining the conveyed ampuls within their respective work stations for processing the ampuls during dwell time periods which alternate with said advancement time periods;

(b) means for continuously guiding ampuls along the path during both said time periods, including an upstream portion having a predetermined width transversely of the path, a downstream portion having a transverse width less than the predetermined transverse width of said upstream portion, and a throat portion intermediate said upstream and downstream portions and having a transverse width less than the predetermined width of said upstream portion but greater than the transverse width of said downstream portion, said upstream, throat and downstream portions all converging in smooth continuous manner downstream of the path;

(c) anti-jamming means for periodically preventing ampuls being guided through said guiding means during both said time periods from jamming generally transversely across the path to thereby bridge and block the same, said anti-jamming means including a movable agitator adjacent said guiding means, and means for intially moving said agitator in a first direction generally transversely across the path between a retracted position away from the path towards an extended position in which said agitator projects partially transversely across the path to thereby engage ampuls being guided along the same, and for subsequently moving said agitator in a second direction generally upstream of the path while the agitator remains in its extended position from one end operating position adjacent said downstream portion towards another end operating position adjacent said upstream portion to thereby displace ampuls engaged by said agitator in countercurrent direction of the path; and (d) means for continuously feeding at least one ampul to said intermittent conveying means during each dwell time period, and for continuously feeding at least one additional ampul to said intermittent conveying means during each advancement time period to thereby utilize both time periods of each operating cycle of the conveying means whereby the ampul handling capability of the machine is increased.

32. In an ampul processing machine having successive work stations arranged along a path, a combination comprising:

(a) intermittent conveying means for advancing ampuls in spaced-apart relationship along the path during advancement time periods in which the ampuls are conveyed from one work station towards the next, and for maintaining the conveyed ampuls within their respective work stations for processing the ampuls during dwell time periods which alternate with said advancement time periods;

(b) means for continuously guiding ampuls along the path during both said time periods, including an upstream portion having a predetermined width transversely of the path, a downstream portion having a transverse width less than the predetermined transverse width of said upstream portion, and a throat portion intermediate said upstream and downstream portions and having a transverse width of said upstream portion but greater than the transverse width of said downstream portion, said upstream, throat and downstream portions all converging in smooth continuous manner downstream of the path;

(c) anti-jamming means for periodically preventing ampuls being guided through said guiding means during both said time periods from jamming generally transversely across the path to thereby bridge and block the same, said anti-jamming means including a removable agitator adjacent said guiding means, and means for initially moving said agitator in a first direction generally transversely across the path between a retracted position away from the path towards an extended position in which said agitator projects partially transversely across the path to thereby engage ampuls being guided along the same, and for subsequently moving said agitator in a second direction generally upstream of the path while the agitator remains in its extended position from one end operating position adjacent said downstream portion towards another end operating position adjacent said upstream portion to thereby displace ampuls engaged by said agitator in countercurrent direction of the path;

(d) means for continuously feeding at least one ampul to said intermittent conveying means during each dwell time period, and for continuously feeding at least one additional ampul to said intermittent conveying means during each advancement time period to thereby utilize both time periods of each operating cycle of the conveying means; and (e) means for discharging ampuls from said intermittent conveying means during each dwell time period by initially moving the ampuls to be discharged in their spaced-apart relationship away from the conveying means, and by subsequently moving the ampuls to be discharged to a closed contiguous relationship prior to moving all of the ampuls to be discharged in their contiguous relationship downstream of the path, whereby the ampul handling capability of the machine is improved.

* * * * *